US010201851B2

(12) United States Patent
Funakoshi et al.

(10) Patent No.: US 10,201,851 B2
(45) **Date of Patent: *Feb. 12, 2019**

(54) CASTING DEVICE AND MOLD REPLACEMENT METHOD FOR CASTING DEVICE

(71) Applicant: SINTOKOGIO, LTD., Nagoya-shi, Aichi (JP)

(72) Inventors: Yukiyoshi Funakoshi, Toyokawa (JP); Keishiro Kaneda, Toyokawa (JP); Hisashi Harada, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 91 days.

This patent is subject to a terminal disclaimer.

(21) Appl. No.: 15/516,483

(22) PCT Filed: Jun. 10, 2015

(86) PCT No.: PCT/JP2015/066787

§ 371 (c)(1),
(2) Date: Apr. 3, 2017

(87) PCT Pub. No.: WO2016/103763

PCT Pub. Date: Jun. 30, 2016

(65) Prior Publication Data

US 2018/0229297 A1 Aug. 16, 2018

(30) Foreign Application Priority Data

Dec. 24, 2014 (JP) ..... 2014-259994

(51) Int. Cl.

| | |
|---|---|
| ***B22D 23/00*** | (2006.01) |
| ***B22D 33/02*** | (2006.01) |
| *B22D 35/04* | (2006.01) |

(52) U.S. Cl.
CPC ..... *B22D 23/006* (2013.01); *B22D 33/02* (2013.01); *B22D 35/04* (2013.01)

(58) Field of Classification Search
CPC ..... B22D 23/006; B22D 33/02; B22D 18/04
See application file for complete search history.

(56) References Cited

U.S. PATENT DOCUMENTS

| | | |
|---|---|---|
| D153,578 S | 5/1949 | Bohannon |
| 3,170,203 A | 2/1965 | Harrison et al. |

(Continued)

FOREIGN PATENT DOCUMENTS

| | | |
|---|---|---|
| CN | 1964805 | 5/2007 |
| CN | 101232961 | 7/2008 |

(Continued)

OTHER PUBLICATIONS

Office Action dated Jun. 6, 2016 for Taiwanese Patent Application No. 104119168.

(Continued)

*Primary Examiner* — Kevin E Yoon
(74) *Attorney, Agent, or Firm* — Drinker Biddle & Reath LLP

(57) ABSTRACT

A casting apparatus includes an upper frame to which an upper mold is attached, a lower frame to which a lower mold is attached, an opening/closing mechanism, a first main link member whose central portion is provided with a rotating shaft, a first auxiliary link member whose central portion is provided with a rotating shaft, and a drive unit. The upper frame, the lower frame, the first main link member, and the first auxiliary link member constitute a first parallel link mechanism.

20 Claims, 16 Drawing Sheets

(56) References Cited

U.S. PATENT DOCUMENTS

| | | | |
|---|---|---|---|
| D208,431 | S | 8/1967 | Paulson, Jr. |
| 3,547,184 | A | 12/1970 | Kock et al. |
| 3,697,038 | A | 10/1972 | Stebakov et al. |
| 3,799,240 | A | 3/1974 | Baumann et al. |
| 3,866,666 | A | 2/1975 | Wunder |
| 3,971,432 | A | 7/1976 | Hardey |
| 4,088,175 | A | 5/1978 | Cecere |
| 4,154,286 | A | 5/1979 | Glazunov et al. |
| 4,240,497 | A | 12/1980 | Glazunov et al. |
| 4,345,893 | A | 8/1982 | Prince |
| D266,327 | S | 9/1982 | Haight et al. |
| 4,385,877 | A | 5/1983 | Tanabe |
| 4,417,616 | A | 11/1983 | Seitz |
| 4,595,044 | A | 6/1986 | Caugherty et al. |
| 4,706,484 | A | 11/1987 | Dittmar et al. |
| 4,719,676 | A | 1/1988 | Sansone |
| D296,701 | S | 7/1988 | Lindell |
| D330,899 | S | 11/1992 | Holbl |
| D331,248 | S | 11/1992 | Yeh |
| 5,207,264 | A | 5/1993 | You |
| D336,479 | S | 6/1993 | Shinagawa et al. |
| 5,379,827 | A | 1/1995 | Perrella et al. |
| D357,484 | S | 4/1995 | Montague et al. |
| 5,595,236 | A | 1/1997 | Lee et al. |
| 5,964,274 | A | 10/1999 | Brinkley |
| D472,908 | S | 4/2003 | Schaer |
| 6,772,819 | B2 | 8/2004 | Shiose et al. |
| 6,942,010 | B2 | 9/2005 | Osugi et al. |
| 6,978,823 | B2 | 12/2005 | Thibault et al. |
| D547,336 | S | 7/2007 | Kai |
| D553,653 | S | 10/2007 | Kai |
| D617,356 | S | 6/2010 | Wang |
| 7,806,161 | B2 | 10/2010 | Jezwinski |
| D651,623 | S | 1/2012 | Stillwell et al. |
| 8,225,842 | B2 | 7/2012 | Taniguchi |
| 8,261,809 | B2 | 9/2012 | Shiose et al. |
| D690,331 | S | 9/2013 | Kitamura |
| D733,201 | S | 6/2015 | Baak |
| 9,156,085 | B2 | 10/2015 | Zammattio |
| 9,289,821 | B2 | 3/2016 | Lee et al. |
| 9,370,822 | B2 | 6/2016 | Boni et al. |
| 9,868,152 | B2 * | 1/2018 | Funakoshi ..... B22D 23/00 |
| 2008/0303183 | A1 | 12/2008 | Rote et al. |

FOREIGN PATENT DOCUMENTS

| | | | | |
|---|---|---|---|---|
| EA | 11340 | B1 | | 2/2009 |
| JP | H05-318090 | A | | 12/1993 |
| JP | H09-225622 | A | | 9/1997 |
| JP | 2003-205359 | A | | 7/2003 |
| JP | 1207346 | S | | 6/2004 |
| JP | 2005118783 | A | * | 5/2005 |
| JP | 2007-54850 | A | | 3/2007 |
| JP | 2007-83293 | A | | 4/2007 |
| JP | 1361322 | S | | 6/2009 |
| JP | 2010-5649 | A | | 1/2010 |
| JP | 2011-79047 | A | | 4/2011 |
| JP | 2012-196698 | A | | 10/2012 |
| JP | 5158501 | | | 3/2013 |
| SU | 1126369 | A1 | | 11/1984 |
| SU | 1675051 | A1 | | 9/1991 |
| TW | 442222 | | | 6/2001 |
| TW | 200531764 | A | | 10/2005 |
| TW | D159161 | S | | 3/2014 |

OTHER PUBLICATIONS

Notice of Allowance dated Mar. 29, 2016 for Taiwanese Design Patent Application No. 104304641.

Notice of Allowance dated Jul. 19, 2016 for Design U.S. Appl. No. 29/537,302.

Official Notification dated Oct. 13, 2015 for Japanese Design Patent Application No. D2015-003919.

International Preliminary Report on patentability (IPRP) dated Jul. 6, 2017 that issued in WO Patent Application No. PCT/JP2015/066787.

* cited by examiner

CASTING DEVICE AND MOLD REPLACEMENT METHOD FOR CASTING DEVICE

TECHNICAL FIELD

The present disclosure relates to a casting apparatus and a method for replacing molds of the casting apparatus.

BACKGROUND

Patent Literatures 1 and 2 disclose tilting gravity mold casting apparatuses. The apparatuses include upper and lower molds being able to be opened, closed, and tilted, and cast a product by pouring molten metal into the upper and lower molds by means of gravity while turning and tilting the upper and lower molds closed. The apparatuses adopt an upper mold flip-up system in which the upper mold opens at approximately 90 degrees so that the upper mold shifts from a horizontal state to an erected state. An apparatus of the upper mold flip-up system includes a stopper for preventing the upper mold from opening at the time of mold closing. In addition, the apparatus of the upper mold flip-up system is provided with an actuator in each of a flip-up mechanism, a stopper, a tilting mechanism, a mold closing mechanism, a mold removal mechanism for each of upper and lower molds, and the like.

CITATION LIST

Patent Literature

Patent Literature 1: Japanese Patent Application Laid-Open No. 05-318090

Patent Literature 2: Japanese Patent Application Laid-Open No 2003-205359

SUMMARY

The flip-up mechanism described above receives a large load at the time of mold closing and mold removal, or pushing out a product. Thus, the flip-up mechanism uses a high strength member with sufficient strength. In addition, the stopper described above is required. Further, since an actuator is provided in each of the flip-up mechanism, the stopper, the tilting mechanism, the mold closing mechanism, the mold removal mechanism for each of upper and lower molds, and the like, there are many actuators in the whole apparatus. Accordingly, a structure of the apparatus is complicated. As a result, if the upper mold flip-up system is adopted, the apparatus increases in size and weight. In addition, as the number of actuators increases, an actuator output also increases.

Thus, in the present technical field, it is desired to simplify a structure of a casting apparatus to reduce the casting apparatus in size and weight.

A casting apparatus in accordance with one aspect of the present invention forms a casting by using an upper mold and a lower mold, being able to be opened, closed, and tilted, which is poured by means of gravity. The casting apparatus includes an upper frame, a lower frame, an opening/closing mechanism, a first main link member, a first auxiliary link member, and a drive unit. The upper mold is attached to the upper frame. The lower mold is attached to the lower frame. The opening/closing mechanism moves up and down any one of the upper mold and the lower mold to perform mold opening or mold closing of the upper mold and the lower mold. An upper end of the first main link member is rotatably coupled to the upper frame, and a lower end thereof is rotatably coupled to the lower frame, and also a rotating shaft is provided at a central portion thereof. The first auxiliary link member is arranged parallel to the first main link member, and an upper end thereof is rotatably coupled to the upper frame as well as a lower end thereof is rotatably coupled to the lower frame, and also a rotating shaft is provided at a central portion thereof. The drive unit is coupled to the rotating shaft of the first main link member to rotate the first main link member around the rotating shaft. The upper frame, the lower frame, the first main link member, and the first auxiliary link member constitute a first parallel link mechanism.

In the casting apparatus, the upper frame to which the upper mold is attached, and the lower frame to which the lower mold is attached, are coupled to each other by the first main link member and the first auxiliary link member to constitute the first parallel link mechanism, and the rotating shaft is provided at the central portion of each of the first main link member and the first auxiliary link member. In addition, the upper mold or the lower mold is moved up and down by the opening/closing mechanism. Then, the first main link member is turned around the rotating shaft by the drive unit. Accordingly, in a step of mold closing, the upper mold and the lower mold are closed by the opening/closing mechanism, and in a step of tilting, the closed upper mold and lower mold are tilted by the drive unit and the first parallel link mechanism, and also in a step of mold removal, a step of pushing out a product or the like, the upper mold and the lower mold opened by the opening/closing mechanism are allowed to separate from each other in a horizontal direction by the drive unit and the first parallel link mechanism. In this manner, a step of casting, such as mold closing, mold removal, and pushing out a product, is performed in the upper and lower frames coupled by the first parallel link mechanism. In addition, force applied at the time of mold closing, mold removal, or pushing out a product, is to be received by the first parallel link mechanism. As a result, as compared with an apparatus of the upper mold flip-up system, a structure for securing strength of each of members is simplified to enable the members to be reduced in size and weight. Further, while large force is transferred to a base frame supporting the apparatus at the time of mold opening and the like in an apparatus of the upper mold flip-up system, the first parallel link mechanism receives force in the casting apparatus, whereby it is possible to reduce force to be transferred to a base frame supporting the apparatus. Accordingly, it is possible to reduce also the base frame in size and weight. As a result, it is possible to simplify a structure of the casting apparatus to reduce the casting apparatus in size and weight.

In one embodiment, the casting apparatus may further include a second main link member, and a second auxiliary link member. An upper end of the second main link member is rotatably coupled to the upper frame, and a lower end thereof is rotatably coupled to the lower frame, and also a rotating shaft is provided at a central portion thereof. The second auxiliary link member is arranged parallel to the second main link member, and an upper end thereof is rotatably coupled to the upper frame as well as a lower end thereof is rotatably coupled to the lower frame, and also a rotating shaft is provided at a central portion thereof. The upper frame, the lower frame, the second main link member, and the second auxiliary link member constitute a second parallel link mechanism. The first parallel link mechanism and the second parallel link mechanism are arranged parallel to each other so as to face each other across the upper mold and the lower mold.

In this case, force applied at the time of mold closing, mold removal, or pushing out a product, is to be received by the first and second parallel link mechanisms. Accordingly, it is possible to further reduce force to be transferred to the base frame supporting the apparatus.

In another embodiment, the casting apparatus may further include a positioning section for positioning the upper mold and the lower mold in the horizontal direction. In this case, since the upper mold and the lower mold are positioned in the horizontal direction, it is possible to prevent the upper mold and the lower mold from being closed so as to be displaced from each other.

In yet another embodiment, the positioning section may include a key provided at a lower end of a side face of the upper mold, and a groove provided at an upper end of a side face of the lower mold, the groove being able to fit with the key. In this case, the key is fitted into the groove to enable the upper mold and the lower mold to be easily positioned.

In yet another embodiment, the upper mold and the lower mold may be tilted by turning the rotating shaft of the first main link member at 45° to 130° with the drive unit in a state where the upper mold and the lower mold are closed by the opening/closing mechanism. In this manner, it is possible to achieve tilting of the upper mold and the lower mold by combining the opening/closing mechanism and the link mechanism.

In yet another embodiment, in a state where the upper mold and the lower mold are opened by the opening/closing mechanism, the upper mold and the lower mold may be allowed to separate from each other in the horizontal direction by turning the rotating shaft of the first main link member at a prescribed angle with the drive unit. In this manner, it is possible to achieve tilting of the upper mold and the lower mold by combining the opening/closing mechanism and the link mechanism. In addition, since the upper mold and the lower mold are allowed to separate from each other in the horizontal direction in a state where the molds are opened, it is possible to leave spaces below the upper mold and above the lower mold. When a space below the upper mold is left in a case where a casting remains in the upper mold after mold removal of the casting formed from the lower mold, it is possible that the casting is dropped by mold removal from the upper mold to be received by a receiving unit and the like arranged below the upper mold. In addition, when a space above the lower mold is left in a case where a core is fitted, it is possible to fit the core in safety.

In yet another embodiment, a rotation center of the rotating shaft of the first main link member may be aligned with the center of gravity of a rotating unit including the upper mold and the lower mold, opened or closed, and the upper frame and lower frame. In this case, when the upper mold and the lower mold are tilted or allowed to separate from each other in the horizontal direction, it is possible to reduce rotation energy required to turn the upper mold and the lower mold as compared with a case where the rotation center of the rotating shaft of the first main link member is not aligned with the center of gravity of the rotating unit.

In yet another embodiment, the opening/closing mechanism may be provided in the upper frame and perform mold opening and mold closing of the upper mold and the lower mold by moving up and down the upper mold. The casting apparatus may further include a pushing out mechanism. The pushing out mechanism may include a pushing out plate, a pushing out pin, a return pin, and a regulation member. The pushing out plate is able to move up and down, and is arranged in a space formed inside an upper end of the upper mold. The pushing out pin is provided in a lower face of the pushing out plate to move up and down through a hole penetrating from the space of the upper mold to a cavity for forming a casting. A leading end of the pushing out pin pushes out the casting in the cavity. The return pin is provided at a position different from that of the pushing out pin in the lower face of the pushing out plate to move up and down through a hole penetrating from the space of the upper mold to the lower face of the upper mold. A leading end of the return pin is brought into contact with an upper face of the lower mold to raise the pushing out plate during a process in which the upper mold and the lower mold are closed. The regulation member is provided in a lower face of the upper frame, and a leading end thereof is arranged above the pushing out plate in the space while inserted into a hole penetrating from an upper face of the upper mold to the space.

In this manner, the pushing out plate provided with the pushing out pin and the return pin is built in the upper mold. When the upper mold is lifted up to an ascending end, the regulation member pushes out the push out pin and the return pin through the pushing out plate. Accordingly, an actuator for pushing out a casting from the upper mold is unnecessary.

In yet another embodiment, the opening/closing mechanism may be provided in the lower frame and perform mold opening and mold closing of the upper mold and the lower mold by moving up and down the lower mold. The casting apparatus may further include a pushing out mechanism. The pushing out mechanism may include a pushing out plate, a pushing out pin, a return pin, and a regulation member. The pushing out plate is able to move up and down, and is arranged in a space formed inside a lower end of the lower mold. The pushing out pin is provided in an upper face of the pushing out plate to move up and down through a hole penetrating from the space of the lower mold to the cavity for forming a casting. A leading end of the pushing out pin pushes out a casting in the cavity. The return pin is provided at a position different from that of the pushing out pin in the upper face of the pushing out plate to move up and down through a hole penetrating from the space of the lower mold to the upper face of the lower mold. A leading end of the return pin is brought into contact with the lower face of the upper mold to lower the pushing out plate during a process in which the upper mold and the lower mold are closed. The regulation member is provided in an upper face of the lower frame, and a leading end thereof is arranged below the pushing out plate in the space while inserted into a hole penetrating from a lower face of the lower mold to the space.

In this manner, the pushing out plate provided with the pushing out pin and the return pin is built in the lower mold. When the lower mold is pulled down to a descending end, the regulation member pushes out the push out pin and the return pin through the pushing out plate. Accordingly, an actuator for pushing out a casting from the lower mold is unnecessary.

In yet another embodiment, the casting apparatus may further include a thermal insulation cover arranged in a space between at least one of the first main link member and the first auxiliary link member, and at least one of the upper mold and the lower mold. In this case, it is possible to reduce influence of heat of at least one of the upper mold and the lower mold, to be applied to at least one of the first main link member and the first auxiliary link member.

A method of replacing molds in accordance with another aspect of the present invention is a method of replacing molds of the casting apparatus described above, and the method includes the steps of: releasing attachment of the upper mold by the upper frame in a state where the upper mold and the lower mold are closed by the opening/closing mechanism; allowing the upper frame and lower frame to separate from each other in the horizontal direction by turning the rotating shaft of the first main link member at a prescribed angle with the drive unit to operate the first parallel link mechanism; releasing attachment of the lower mold by the lower frame; and extracting the upper mold and the lower mold from the lower frame to mount another upper mold and lower mold on the lower frame.

Since the method of replacing molds uses the casting apparatus described above, it is possible to allow the upper frame and lower frame to separate from each other in the horizontal direction in a state where the upper mold from which the attachment by the upper frame is released is mounted on the lower mold. Accordingly, since a space above the upper mold and the lower mold integrated is left, it is possible to easily and safely replace the molds.

According to a variety of aspects and embodiments of the present invention, it is possible to simplify a structure of the casting apparatus to reduce the casting apparatus in size and weight.

DETAILED DESCRIPTION

Figure 1:
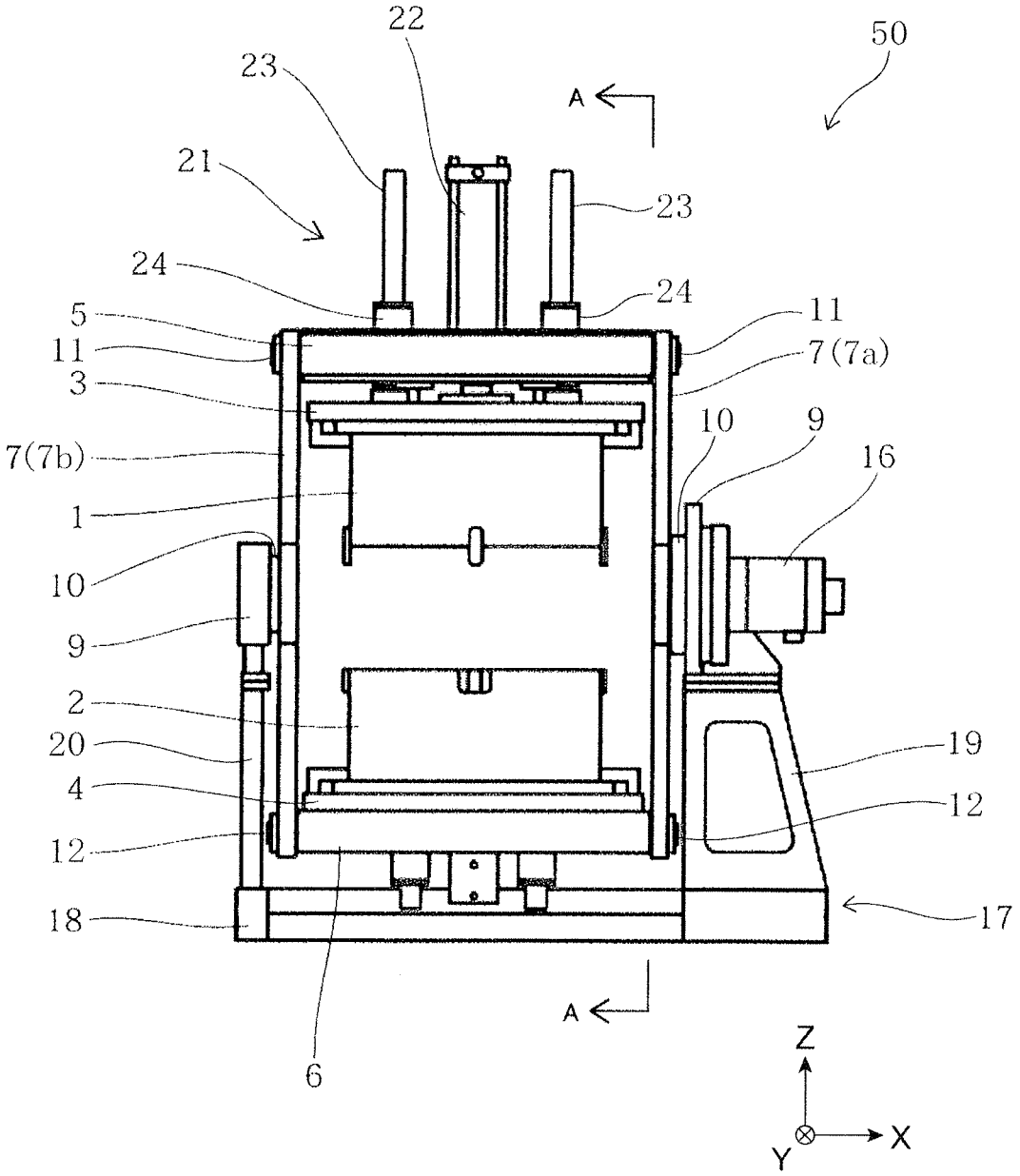
FIG. 1 is a front view of a casting apparatus in accordance with a first embodiment.

Hereinafter, embodiments of the present invention will be described with reference to the accompanying drawings. In description of the drawings, the same element is designated by the same reference numeral without duplicated description on the element. In addition, a dimension ratio of the drawings does not always agree with an actual ratio of a described matter. Further, each of terms of "upper", "lower", "left", and "right" is a state based on a state shown in the drawings, and is shown for convenience.

(First Embodiment

Figure 2:
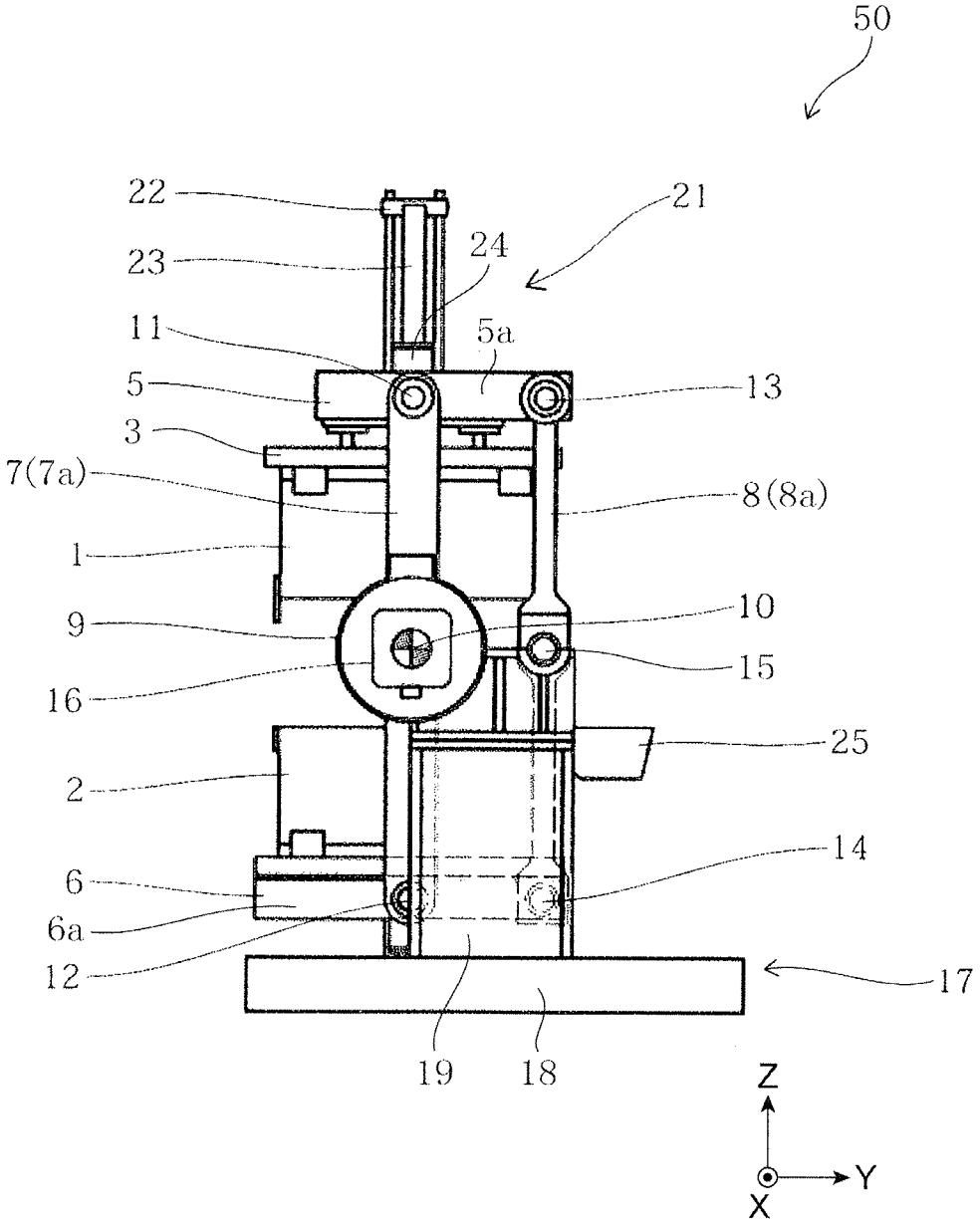
FIG. 2 is a side view of the casting apparatus of FIG. 1.

With reference to FIGS. 1 and 2, a structure of a casting apparatus 50 will be described. FIG. 1 is a front view of a casting apparatus in accordance with a first embodiment. FIG. 2 is a side view of the casting apparatus of FIG. 1. In FIGS. 1 and 2, each of an X direction and a Y direction is a horizontal direction, and a Z direction is a vertical direction. Hereinafter, the X direction is also referred to as a lateral direction and the Z direction is also referred to as an up-and-down direction.

The casting apparatus 50 is so-called a tilting gravity mold casting apparatus that forms a casting by using an upper mold 1 and a lower mold 2, capable of opening/closing and tilting, into which molten metal is poured by means of gravity. Any material is available for the molten metal to be poured. For example, aluminum alloy, magnesium alloy, and the like are available for the molten metal. The casting apparatus 50 includes a controller to be able to control operation of each component.

As shown in FIGS. 1 and 2, the casting apparatus 50 includes, for example, a base frame 17, an upper frame 5, a lower frame 6, an opening/closing mechanism 21, a left-and-right pair of main link members 7 (a first main link member 7*a*, and a second main link member 7*b*), a left-and-right pair of auxiliary link members 8 (a first auxiliary link member 8*a*, and a second auxiliary link member 8*b*), a rotation actuator (drive unit) 16, and a ladle 25.

The base frame 17 includes a base 18, a drive side support frame 19, and a driven side support frame 20. The base 18 is a substantially plate-like member composed of a combination of a plurality of members, and is horizontally provided on an installation surface of the casting apparatus 50. The drive side support frame 19 and the driven side support frame 20 are erected on the base 18 so as to face each other in the lateral direction (horizontal direction), and are fixed to the base 18. One of a pair of tilt rotation bearings 9 is provided in an upper end of the drive side support frame 19 and an upper end driven side support frame 20.

The upper frame 5 is arranged above the base frame 17. The upper mold 1 is attached to the upper frame 5. Specifically, the upper mold 1 is attached to a lower face of the upper frame 5 through an upper mold die base 3. The opening/closing mechanism 21 for moving up and down the upper mold 1 is provided in the upper frame 5. Specifically, the upper frame 5 has the opening/closing mechanism 21 built in, and the upper mold 1 is held by the opening/closing mechanism 21 so as to be able to move up and down.

The opening/closing mechanism 21 includes a mold closing cylinder 22, a left-and-right pair of guide rods 23, and a left-and-right pair of guide cylinders 24. A lower end of the mold closing cylinder 22 is attached to an upper face of the upper mold die base 3. The mold closing cylinder 22 is extended in the up-and-down direction (the vertical direction, here the Z direction) to lower the upper mold 1 through the upper mold die base 3, as well as is shortened in the up-and-down direction to raise the upper mold 1 through the upper mold die base 3. The guide rod 23 is attached to the upper face of the upper mold die base 3 through the guide cylinder 24 attached to the upper frame 5.

The lower frame 6 is arranged above the base frame 17 and below the upper frame 5. The lower mold 2 is attached to the lower frame 6. Specifically, the lower mold 2 is attached to an upper face of the lower frame 6 through a lower mold die base 4. In a state shown in each of FIGS. 1 and 2, the upper frame 5 and the lower frame 6 face each other in the up-and-down direction. Likewise, the upper mold 1 and the lower mold 2 face each other in the up-and-down direction. The opening/closing mechanism 21 moves up and down the upper mold 1 to perform mold opening and mold closing of the upper mold 1 and the lower mold 2.

The first main link member 7*a* is an elongated-strip-shape member. The first main link member 7*a* is a rod-like member with a rectangular cross section, for example. An upper end of the first main link member 7*a* is rotatably coupled to the upper frame 5, and a lower end thereof is rotatably coupled to the lower frame 6, and also a tilt rotating shaft 10 is provided at a central portion thereof. The first main link member 7*a* is provided at its upper end with a main link upper rotating shaft 11, and is provided at its lower end with a main link lower rotating shaft 12. In the present embodiment, two main link members are provided. The second main link member 7*b* has the same structure as that of the first main link member 7*a*. A pair of main link members 7 are arranged so as to face each other in the lateral direction (the horizontal direction, here the X direction), and each of the main link members 7 couples the upper frame 5 and the lower frame 6 to each other. Here, the pair of main link members 7 is arranged parallel to each other by facing each other across the upper mold 1 and the lower mold 2.

Central portions of the pair of main link members 7 are rotatably coupled to a pair of tilt rotation bearings 9 through a pair of tilt rotating shafts 10. Upper ends of the pair of main link members 7 are rotatably coupled to a pair of side faces 5*a* of the upper frame 5 through a pair of main link upper rotating shafts 11. Lower ends of the pair of main link members 7 are rotatably coupled to a pair of side faces 6*a* of the lower frame 6 through a pair of main link lower rotating shafts 12. Attachment positions of the pair of main link members 7 to the upper frame 5 and the lower frame 6 are set so that each of the pair of main link members 7 is positioned at the center of the upper mold 1 and the lower mold 2 in a depth direction (Y direction) orthogonal to the lateral direction and the up-and-down direction when the upper mold 1 and the lower mold 2 are closed.

The first auxiliary link member 8*a* is an elongated-strip-shape member. The first auxiliary link member 8*a* is a rod-like member with a rectangular cross section, for example. The first auxiliary link member 8*a* is arranged parallel to the first main link member 7*a*, and an upper end thereof is rotatably coupled to the upper frame 5 as well as a lower end thereof is rotatably coupled to the lower frame 6, and also an auxiliary link central portion rotating shaft 15 is provided at a central portion thereof. The first auxiliary link member 8*a* is provided at its upper end with an auxiliary link upper rotating shaft 13, and is provided at its lower end With an auxiliary link bottom rotating shaft 14. In the present embodiment, two auxiliary link members are provided. The second auxiliary link member 8*b* (not shown) has the same structure as that of the first auxiliary link member 8*a*. A pair of auxiliary link members 8 are arranged so as to face each other in the lateral direction to couple the upper frame 5 and the lower frame 6 to each other. The pair of auxiliary link members 8 is provided in a pair of side faces 5*a* and a pair of side faces 6*a* so as to be parallel to the pair of main link members 7. Length of the auxiliary link member 8 is the same as that of the main link member 7.

Upper ends of the pair of auxiliary link members 8 are rotatably coupled to a pair of side faces 5*a* of the upper frame 5 through a pair of auxiliary link upper rotating shafts 13. Lower ends of the auxiliary link members 8 are rotatably coupled to a pair of side faces 6*a* of the lower frame 6 through a pair of auxiliary link lower rotating shafts 14. An attachment position of the auxiliary link member 8 is on a side, where the ladle 25 is arranged, with respect to the main link member 7. The auxiliary link central portion rotating shaft 15 is mounted above the base frame 17. In a state of FIGS. 1 and 2, the auxiliary link central portion rotating shaft 15 is mounted above an upper face of the drive side support flume 19.

In this manner, the upper frame 5, the lower frame 6, the first main link member 7*a*, and the first auxiliary link member 8*a* constitute a parallel link mechanism (first parallel link mechanism). Likewise, the upper frame 5, the lower frame 6, the second main link member 7*b*, and the second auxiliary link member 8*b* constitute a parallel link mechanism (second parallel link mechanism). The two parallel link mechanisms are arranged parallel to each other by facing each other across the upper mold 1 and the lower mold 2.

The tilt rotating shaft 10 of the first main link member 7*a* is held in the base frame 17 with the tilt rotation bearing 9 provided outside the first parallel link mechanism. A rotation center of the tilt rotating shaft 10 of the first main link member 7*a* is aligned with the center of gravity of a rotating unit including the upper mold 1 and the lower mold 2, opened or closed, and the upper frame 5 and lower frame 6. Likewise, the tilt rotating shaft 10 of the second main link member 7*b* is held in the base frame 17 with the tilt rotation bearing 9 provided outside the second parallel link mechanism. A rotation center of the tilt rotating shaft 10 of the second main link member 7*b* is aligned with the center of gravity of the rotating unit including the upper mold 1 and the lower mold 2, opened or closed, and the upper frame 5 and lower frame 6. Here, the term, "aligned", is not limited to a case where both is completely aligned, and includes also a case where there is deviation due to a difference between the upper mold 1 and the lower mold 2 in weight.

The rotation actuator 16 is arranged above the drive side support frame 19. The rotation actuator 16 is provided to be coupled to the tilt rotating shaft 10 of one of the pair of main link members 7. The rotation actuator 16 may be any one of electrically-operated, hydraulically-operated, and pneumatically-operated. The rotation actuator 16 serves as a drive unit that tilts the upper mold 1 and the lower mold 2, or that allows the molds to separate from each other in the horizontal direction.

The upper mold 1 and the lower mold 2 are tilted by turning the tilt rotating shaft 10 of the first main link member 7*a* at 45° to 130° with the rotation actuator 16 in a state where the upper mold 1 and the lower mold 2 are closed by the opening/closing mechanism 21. The upper mold 1 and the lower mold 2 are allowed to separate from each other in the horizontal direction by turning the tilt rotating shaft 10 of the first main link member 7*a* at a prescribed angle with the rotation actuator 16 in a state where the upper mold 1 and the lower mold 2 are opened by the opening/closing mechanism 21. Separation of the upper mold 1 and the lower mold 2 in the horizontal direction is achieved by allowing the first parallel link mechanism to operate with the rotation actuator 16. In the meantime, the second parallel link mechanism also operates in conjunction with movement of the first parallel link mechanism. The second parallel link mechanism is not always required, for example, the upper frame 5 and the lower frame 6 may be coupled to each other by only the first parallel link mechanism and the second main link member 7*b*, or the upper frame 5 and the lower frame 6 may be coupled to each other by only the first parallel link mechanism and the second auxiliary link member 8*b*.

The ladle 25 is attached to an upper end of a side face of the lower mold 2. A storage section for storing molten metal is formed inside the ladle 25. A pouring port 25*a* (refer to FIG. 5) of the ladle 25 is connected to a molten metal receiving port 2*a* (refer to FIG. 5) of the lower mold 2.

Figure 3:
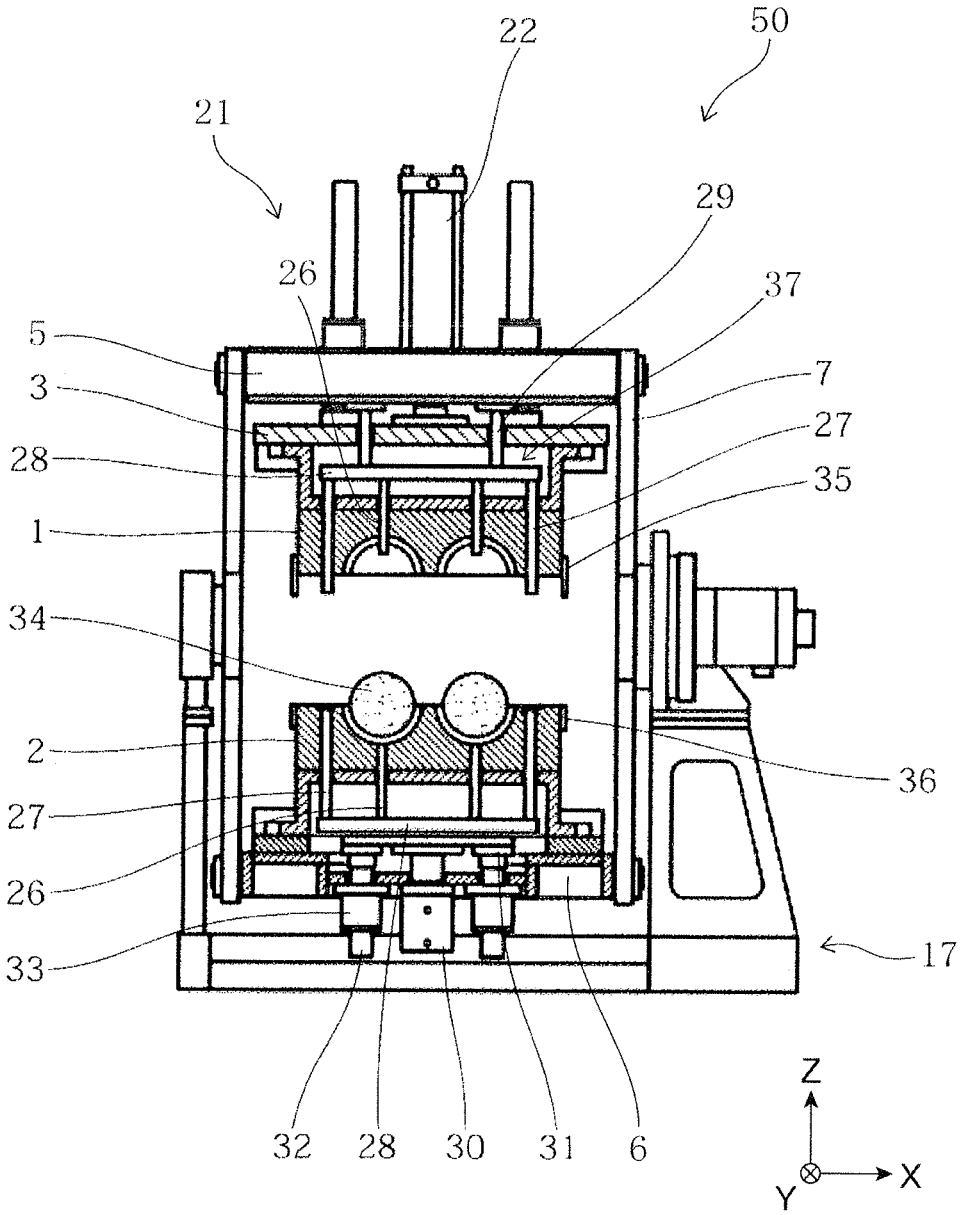
FIG. 3 shows a section of an upper mold and lower mold of FIG. 1.

FIG. 3 shows a section of an upper mold and lower mold of FIG. 1. Here, there is shown a state where a plurality of cores 34 are fitted in an upper face of the lower mold 2. As shown in FIG. 3, the casting apparatus 50 includes a pushing out mechanism 37 that includes a pushing out plate 28, a pair of pushing out pins 26, a pair of return pins 27, and a plurality of push rods (regulation members) 29. The pushing out mechanism 37 is provided in the upper frame 5.

The pushing out plate 28 is arranged in an internal space formed inside an upper end of the upper mold 1. The pushing out plate 28 is housed in the internal space in a state where the pushing out plate 28 is capable of moving up and down. Each of the pushing out pins 26 is provided in a lower face of the pushing out plate 28. Each of the pushing out pin 26 moves up and down through a hole penetrating from the internal space of the upper mold 1 to a cavity for forming a casting. Then, each of the pushing out pins 26 pushes out a casting in the cavity with its leading end. Each of the return pins 27 is provided at a position different from that of each of the pushing out pins 26 in the lower face of the pushing out plate 28. Each of the return pins 27 moves up and down through a hole penetrating from the internal space of the upper mold 1 to a lower face of the upper mold 1. Then, a leading end of each of the return pins 27 is brought into contact with the upper face of the lower mold 2 to raise the pushing out plate 28 during a process in which the upper mold 1 and the lower mold 2 are closed.

Each of the push rods 29 is provided in the lower face of the upper frame 5. In addition, each of the push rods 29 is arranged in the lower face of the upper frame 5 while penetrating the upper mold die base 3. In a state where each of the push rods 29 is inserted into a hole penetrating from an upper face of the upper mold 1 to the internal space, a leading end of each of the push rods 29 is arranged above the pushing out plate 28 in the internal space. Length of each of the push rods 29 is set so that each of the push rods 29 pushes down the pushing out plate 28 when the mold closing cylinder 22 is shortened to allow the upper mold 1 to reach an ascending end. The ascending end is the highest position of the upper mold 1 that can be obtained by shortening the mold closing cylinder 22. That is, each of the push rods 29 enters the internal space by a prescribed length through the hole penetrating from the upper face of the upper mold 1 to the internal space formed in an upper portion of the upper mold 1 to prevent the pushing out plate 28 from rising.

A pushing out cylinder 30 is built in the lower frame 6. An upper end of the pushing out cylinder 30 is attached to a lower face of a pushing out member 31. A left-and-right pair of guide rods 32 is attached to the lower face of the pushing out member 31 through a guide cylinder 33 attached to the lower frame 6.

As with the upper mold 1, the pushing out plate 28 to which the pair of pushing out pins 26 and the pair of return pins 27 are coupled is built in the lower mold 2. In the lower mold 2, there is a positional relationship in which the pushing out member 31 is raised by extending action of the pushing out cylinder 30 to push up the pushing out plate 28, thereby allowing the pair of pushing out pin 26 and return pins 27 to rise. The return pins 27 of the upper mold 1 and the lower mold 2 are pushed back when the molds are closed because their leading ends are pushed back by a mating face of the opposite mold or by leading ends of opposite return pins 27. Accordingly, the pushing out pins 26 coupled to the pushing out plate 28 are also pushed back. In addition, when the molds are closed, the pushing out member 31 reaches a descending end position by shortening action of the pushing out cylinder 30. The descending end is the lowest position of the lower mold 2 that can be obtained by shortening the pushing out cylinder 30.

A pair of positioning keys 35 is attached to the periphery of a lower portion (lower ends of side faces) of the upper mold 1. A pair of key grooves 36 is attached to the periphery of an upper portion (upper ends of side faces) of the lower mold 2 so as to be able to fit with the pair of positioning keys 35. The positioning keys 35 and the key groove 36 constitute a positioning section that positions the upper mold 1 and the lower mold 2 in the horizontal direction. Since the upper mold 1 and the lower mold 2 are positioned in the horizontal direction by the positioning section, it is possible to prevent the upper mold 1 and the lower mold 2 from being closed so as to be displaced from each other.

Figure 4:
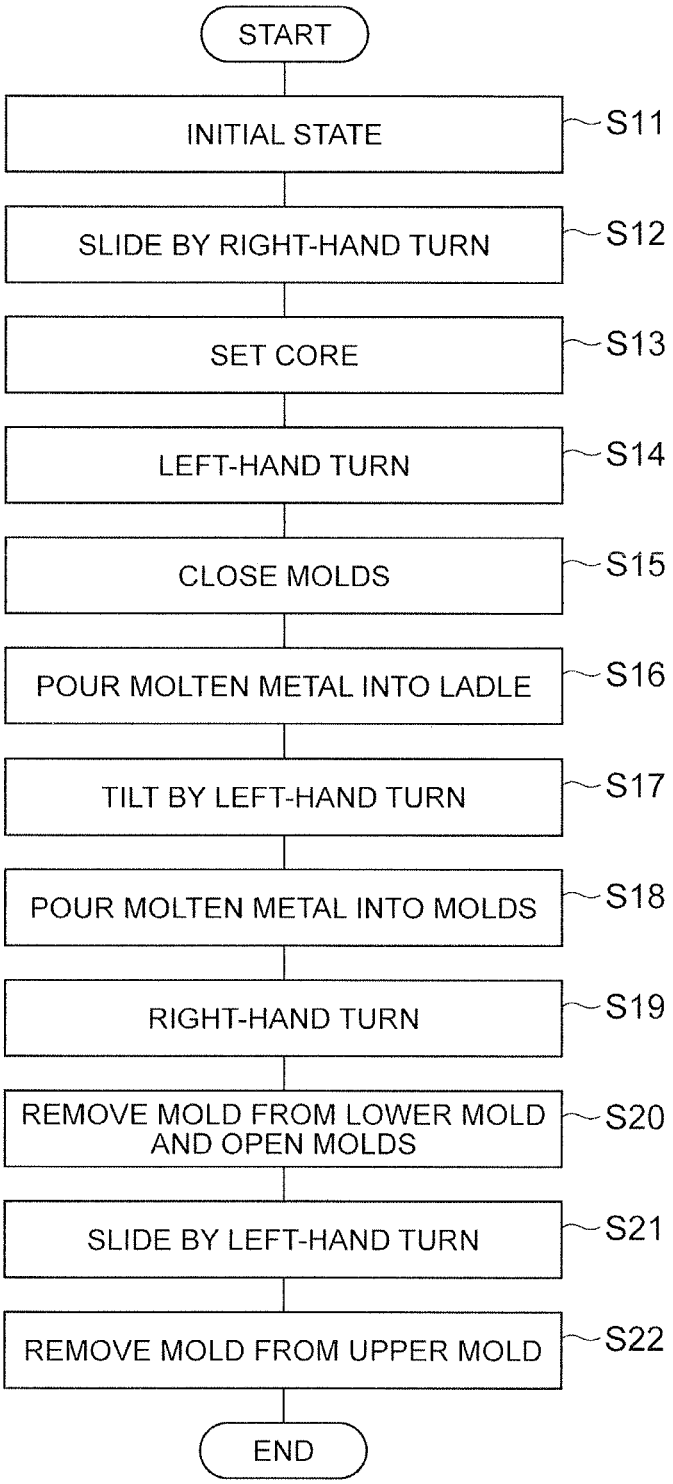
FIG. 4 is a flow chart showing a casting method by using the casting apparatus of FIG. 1.
Figure 5:
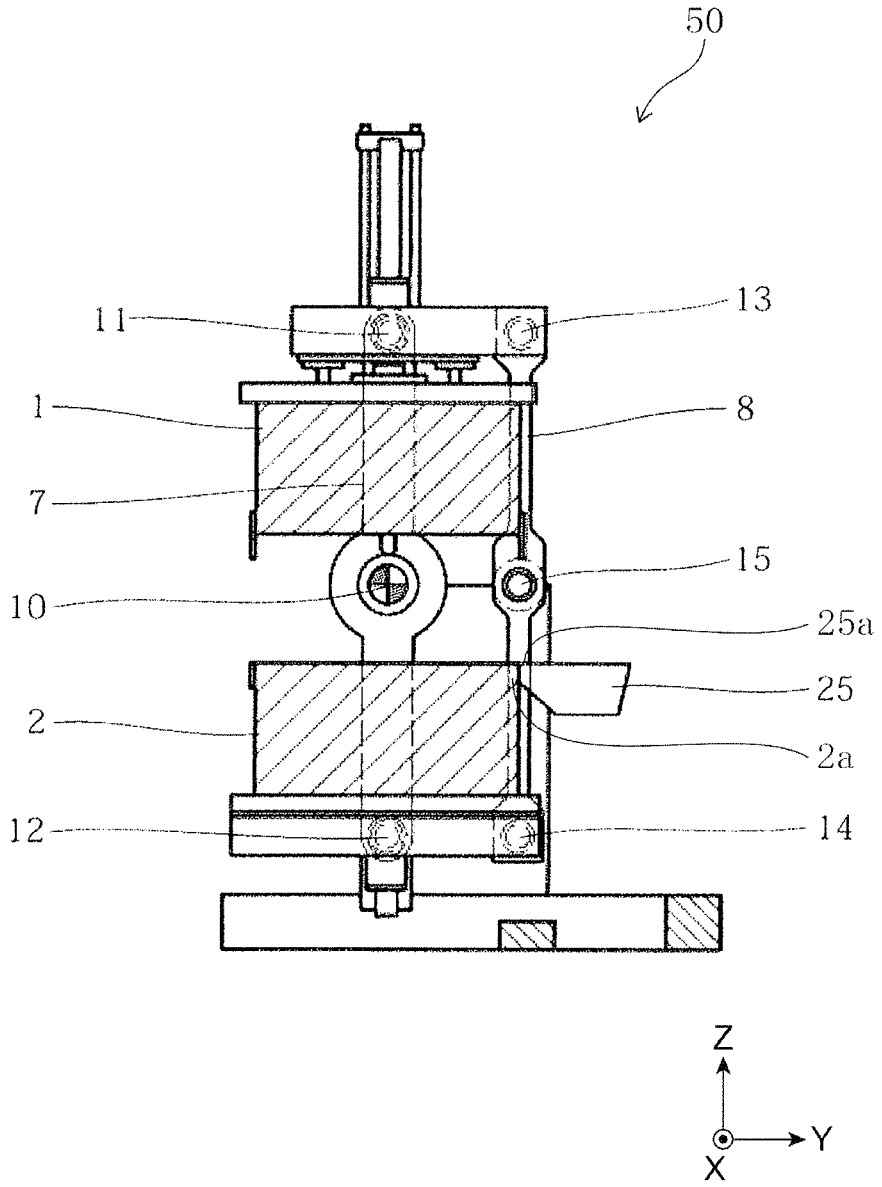
FIG. 5 is an illustration viewed from arrows A-A in FIG. 1 to describe an initial state.
Figure 6:
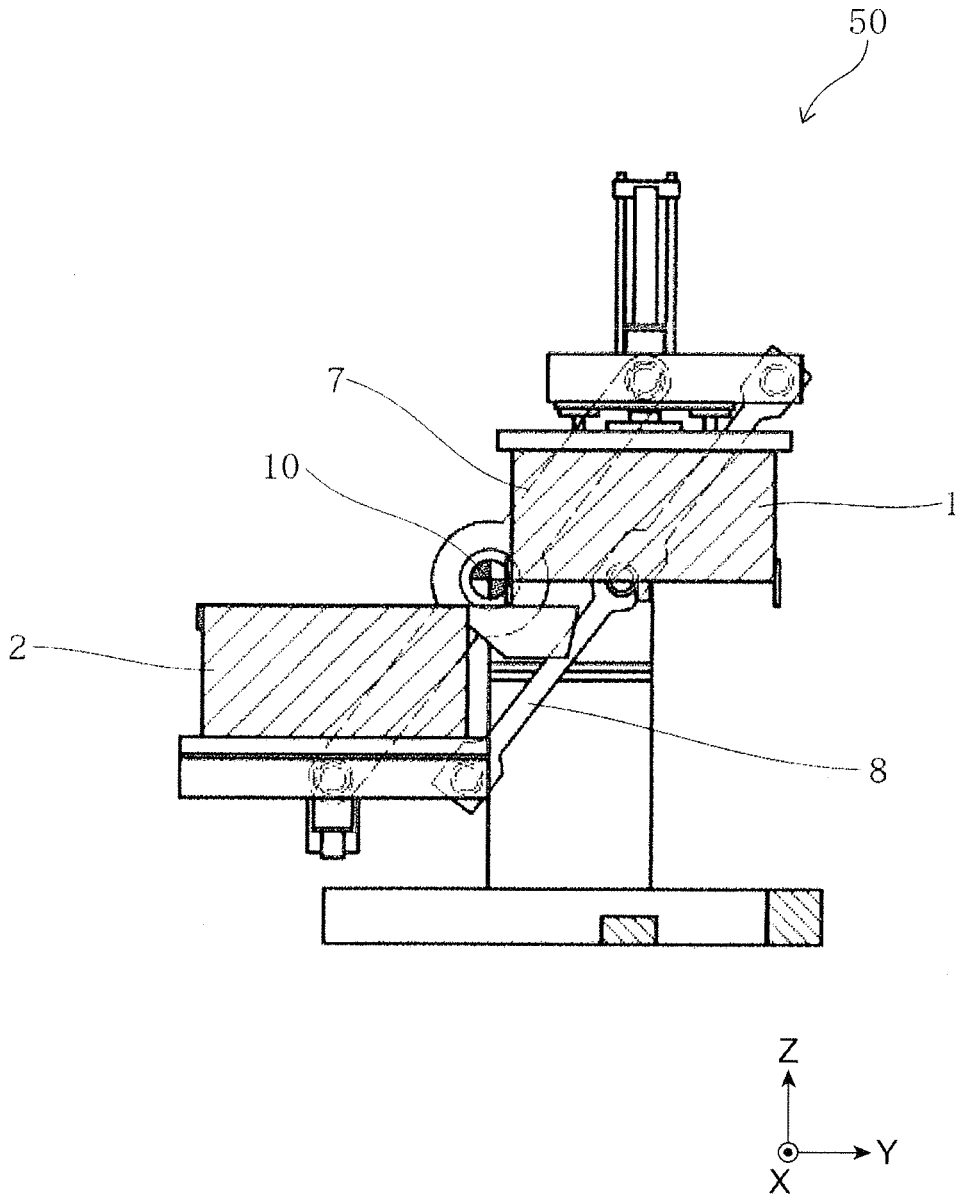
FIG. 6 shows a second separated state after the upper and lower molds are slid by operation of a parallel link mechanism.
Figure 7:
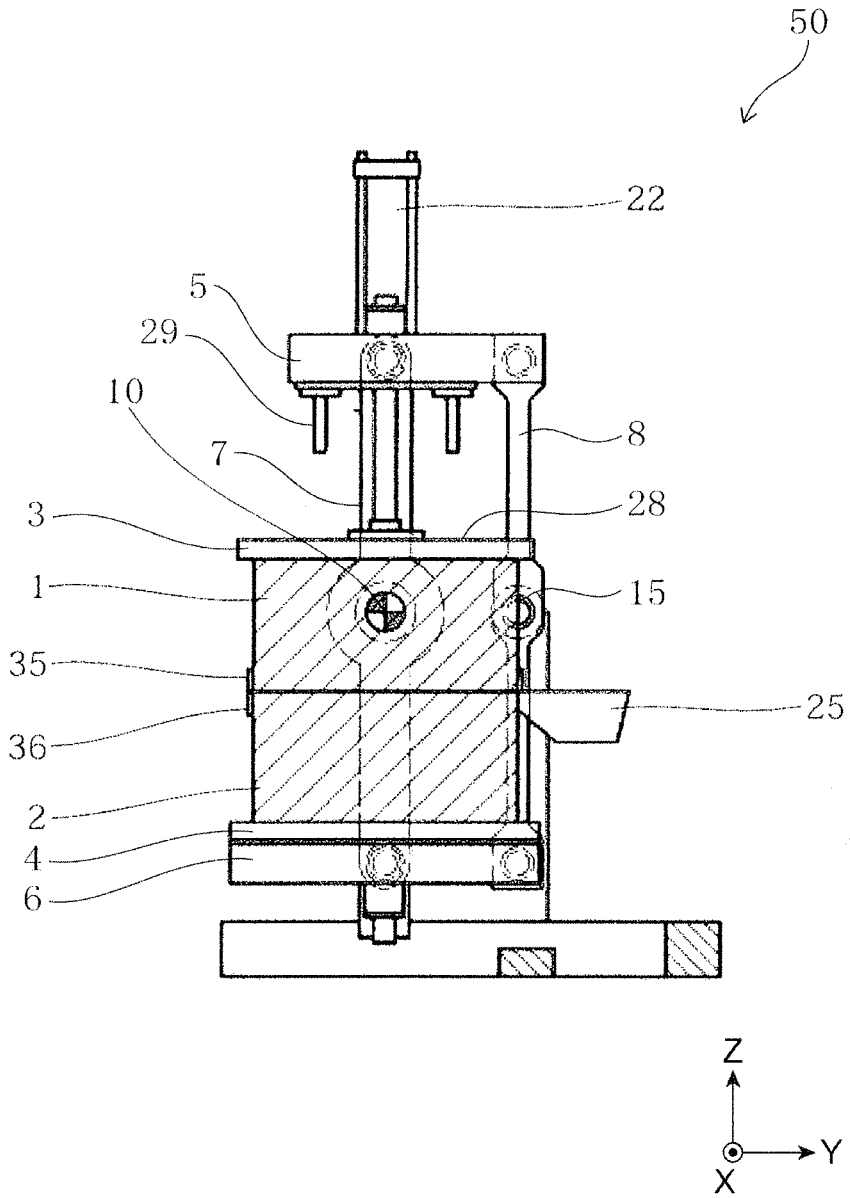
FIG. 7 is an illustration to describe a mold closing state where the upper mold and the lower mold are closed.
Figure 8:
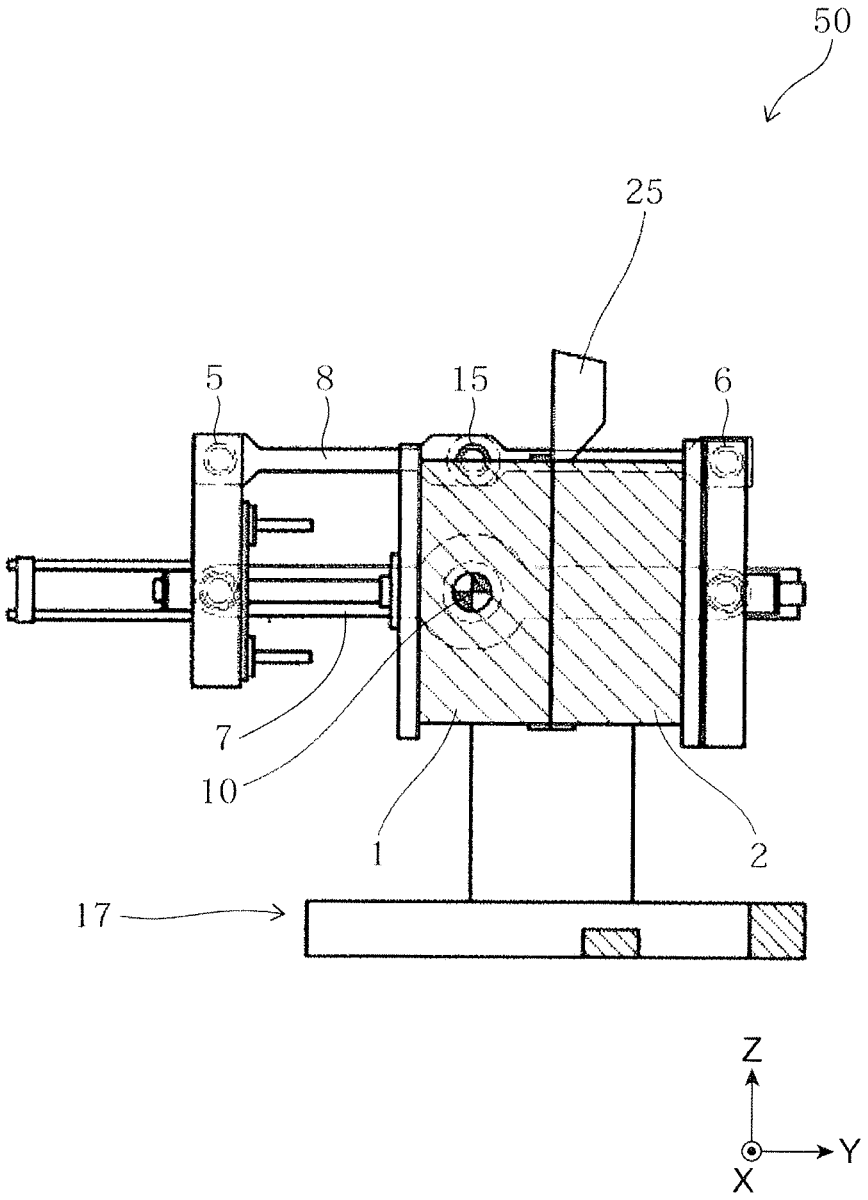
FIG. 8 shows the upper mold and the lower mold closed that are turned at 90°.
Figure 9:
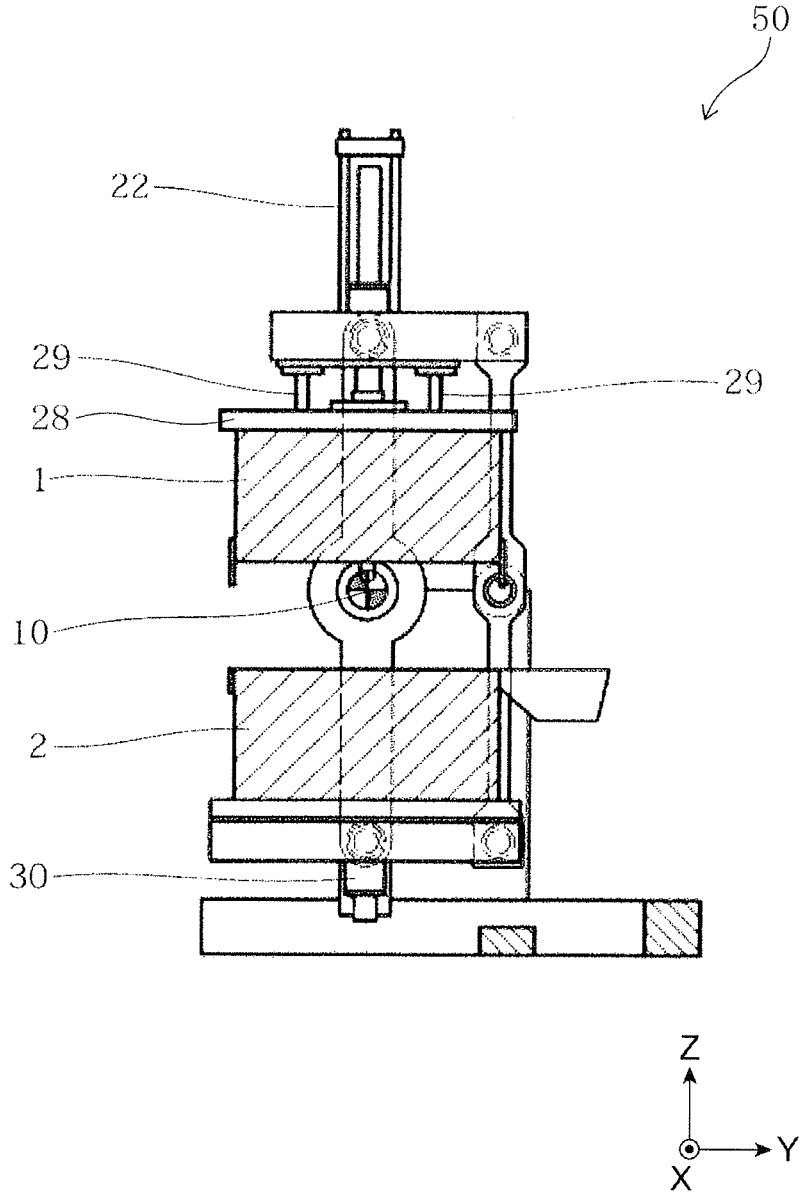
FIG. 9 shows the upper mold that is lifted up to an intermediate position.
Figure 10:
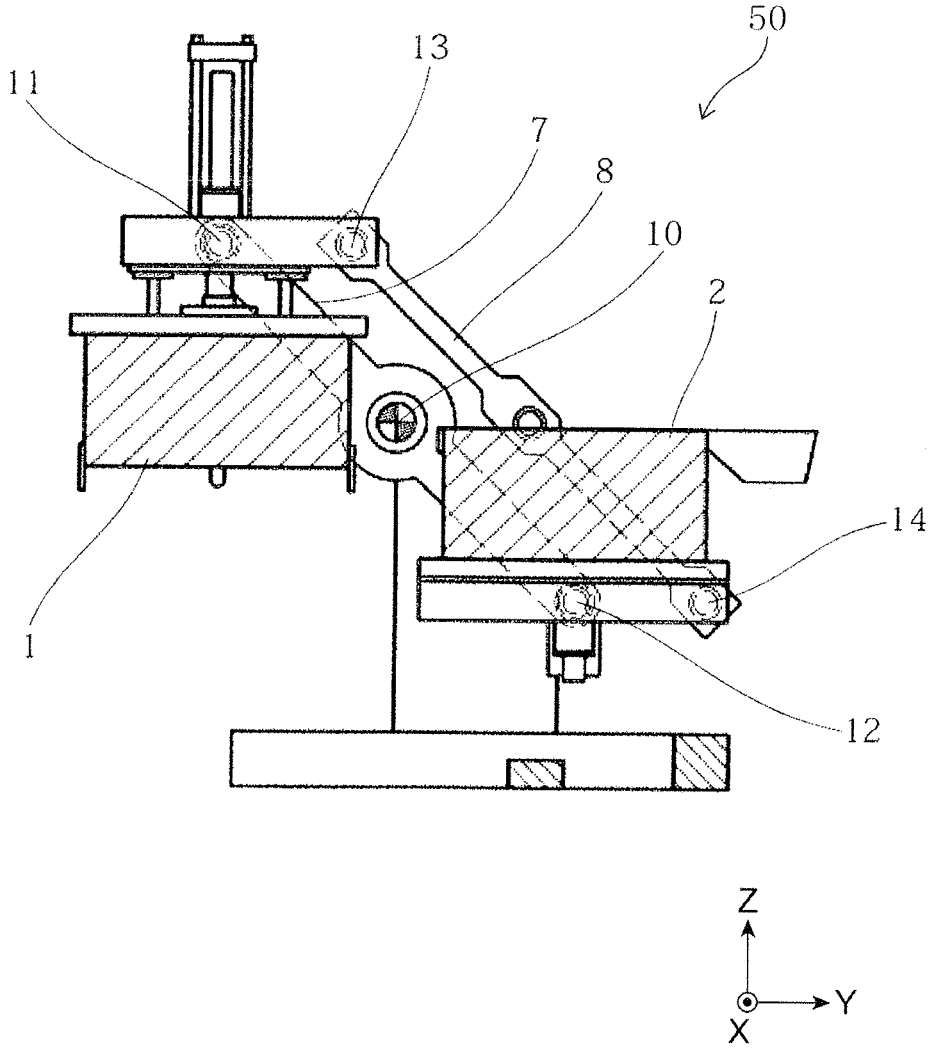
FIG. 10 shows a first separation state after the upper mold and the lower mold are slid.
Figure 11:
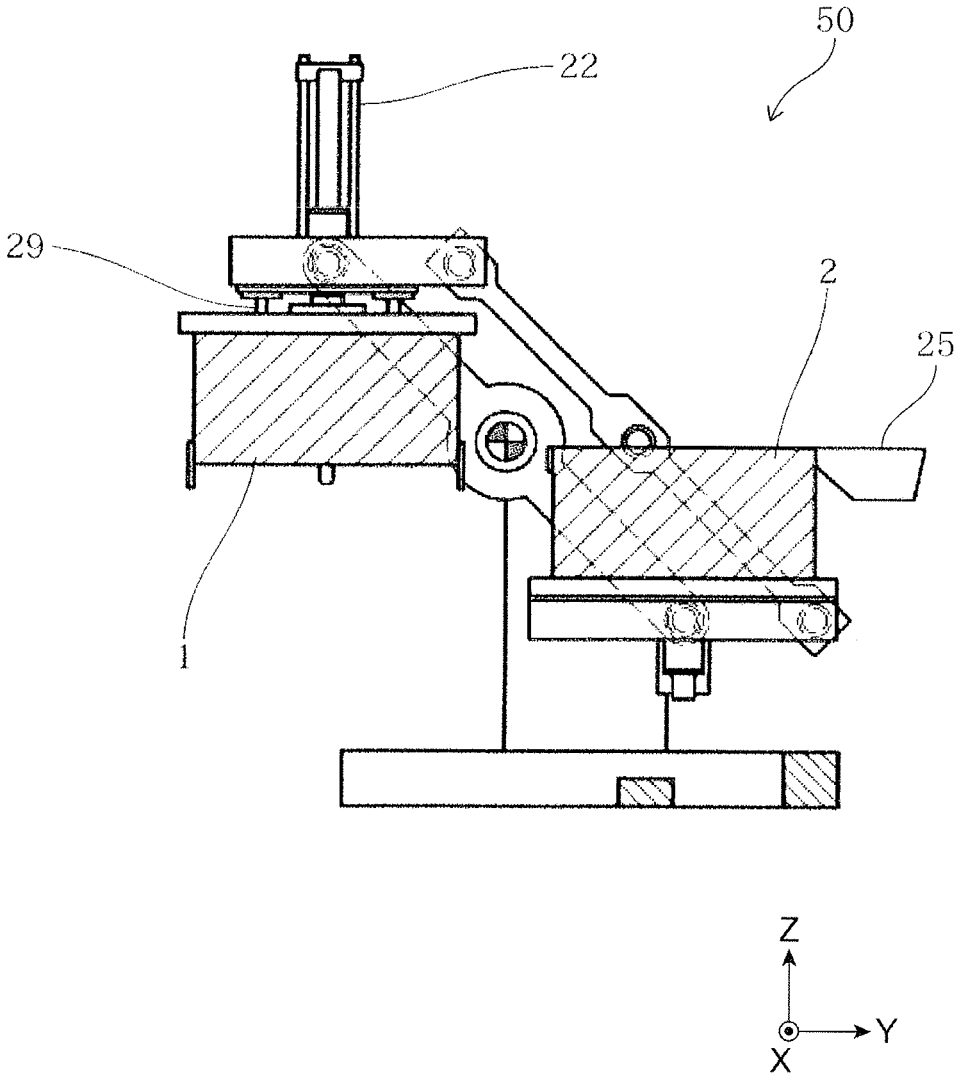
FIG. 11 shows a state where the upper mold is lifted up to an ascending end from the state of FIG. 10.

Subsequently, with reference to FIGS. 4 to 11, an example of a casting method by the casting apparatus 50 will be described. FIG. 4 is a flow chart showing a casting method by using the casting apparatus of FIG. 1. FIG. 5 is an illustration viewed from arrows A-A in FIG. 1 to describe an initial state. FIG. 6 shows a second separated state after the upper and lower molds are slid by operation of a parallel link mechanism. FIG. 7 is an illustration to describe a mold closing state where the upper mold and the lower mold are closed. FIG. 8 shows the upper mold and the lower mold closed that are turned at 90°. FIG. 9 shows the upper mold that is lifted up to an intermediate position. FIG. 10 shows a first separation state after the upper mold and the lower mold are slid. FIG. 11 shows a state where the upper mold is lifted up to an ascending end from the state of FIG. 10.

As shown in FIGS. 4 and 5, first the casting apparatus 50 is set in an initial state of a series of casting steps (S11). In the initial state, the upper mold 1 is positioned at the ascending end, and the pair of main link members 7 and the pair of auxiliary link members 8 are perpendicular to an installation surface of the casting apparatus 50. The casting apparatus 50 is arranged at a position between a work space (not shown) and a pouring apparatus (not shown). The casting apparatus 50 is arranged so that the ladle 25 faces the work space (not shown) in the Y direction. The work space is a space where an operator works for operation such as fitting a core. The pouring apparatus is an apparatus for supplying molten metal to the ladle 25. In addition, a conveyor (not shown) is arranged between the casting apparatus 50 and the work space, for example. The conveyor is an apparatus for conveying a casting (a cast product) formed by the casting apparatus 50. The conveyor extends to apparatuses in downstream steps (such as a product cooler, a shakeout apparatus, and a product finishing apparatus), for example.

Subsequently, as shown in FIGS. 4 and 6, the casting apparatus 50 drives the rotation actuator 16 to turn the tilt rotating shaft 10 of the first main link member 7*a* clockwise. In the present embodiment, a clockwise turn is a right-hand turn, and a reverse turn is a left-hand turn. Accordingly, each of the upper mold 1 and the lower mold 2 slides in a direction opposite to each other along an arc by operation of the parallel link mechanism (S12). Specifically, the upper mold 1 and the lower mold 2, facing each other, move around the tilt rotating shaft 10 in a circular motion of the right-hand turn so that the upper mold 1 and the lower mold 2 move so as to separate from each other in the horizontal direction. In the meantime, the upper mold 1 moves toward a pouring apparatus side to become a second separation state. In the present embodiment, a state where the lower mold 2 moves toward the pouring apparatus side is indicated as a first separation state, and a state where the upper mold 1 moves toward the pouring apparatus side is indicated as the second separation state. That is, the first separation state (refer to FIG. 1.0) is a state where the upper mold 1 is moved in a direction away from the pouring apparatus by the rotation actuator 16 as well as the lower mold 2 is moved in a direction approaching the pouring apparatus by the rotation actuator 16, so that the upper mold 1 and the lower mold 2 separate from each other in the horizontal direction. The second separation state (refer to FIG. 6) is a state where the upper mold 1 is moved in the direction approaching the pouring apparatus by the rotation actuator 16 as well as the lower mold 2 is moved in the direction away from the pouring apparatus by the rotation actuator 16, so that the upper mold 1 and the lower mold 2 separate from each other in the horizontal direction.

Next, the core 34 is fitted in a prescribed position in the lower mold 2 (S13). Fitting of the core 34 is performed by an operator, for example. The core 34 is formed by using a core molding machine (not shown), for example. In the second separation state, a space above the lower mold 2 is opened so that the ladle 25 attached to the lower mold 2 is not brought into contact with the upper mold 1. In this manner, since the space above the lower mold 2 is left, it is possible to fit the core 34 in the lower mold 2 in safety.

Subsequently, the casting apparatus 50 drives the rotation actuator 16 to allow the tilt rotating shaft 10 of the first main link member 7*a* to perform the left-hand turn so that processing temporarily returns to an initial state of FIG. 5 (S14). Next, as shown in FIGS. 4 and 7, the casting apparatus 50 allows the mold closing cylinder 22 to elongate to close the upper mold 1 and the lower mold 2 (S15). In the meantime, the positioning key 35 of the upper mold 1 and the key groove 36 of the lower mold 2 are fitted with each other to fix the upper mold 1 and the lower mold 2 in the horizontal direction. In addition, the molds are closed not to allow the pair of main link members 7, the pair of auxiliary link members 8, the main link upper rotating shaft 11, the main link lower rotating shaft 12, the auxiliary link upper rotating shaft 13, and the auxiliary link bottom rotating shaft 14, to turn, whereby the upper mold 1, the lower mold 2, the upper frame 5, the lower frame 6, the pair of main link members 7, and the pair of auxiliary link members 8, are integrated.

Next, when the upper mold 1 and the lower mold 2 are closed, the pouring apparatus supplies molten metal to the ladle 25 (S16). Subsequently, as shown in FIGS. 4 and 8, the casting apparatus 50 drives the rotation actuator 16 to allow the tilt rotating shaft 10 of the first main link member 7*a* to perform the left-hand turn at approximately 90°, whereby the upper mold 1 and the lower mold 2 become a tilt state (S17). Accordingly, the auxiliary link central portion rotating shaft 15 is lifted up from an upper face of the base frame 17, on which it is mounted. As a result, the upper mold 1, the lower mold 2, the upper frame 5, the lower frame 6, the pair of main link members 7, and the pair of auxiliary link members 8, integrated after the molds are closed, are turned to tilt the ladle 25 to pour the molten metal in the ladle 25 into a cavity formed between the upper mold 1 and the lower mold 2 (S18).

After the process at S18 described above is finished, a state of FIG. 8 is held for a prescribed time to wait for coagulation of the molten metal poured. As described above, here, although the rotation actuator 16 is driven to allow the tilt rotating shaft 10 of the first main link member 7*a* to perform the left-hand turn at approximately 90°, the tilt rotating shaft 10 may be turned at a required angle within a range from 45° to 130° or at a required angle within a range from 45° to 90°.

Subsequently, the casting apparatus 50 drives the rotation actuator 16 to allow the tilt rotating shaft 10 of the first main link member 7*a* to perform the right-hand turn so that the processing temporarily returns to a state of FIG. 7 (S19). Next, mold removal from the lower mold 2 and mold opening are performed in parallel (S20). The mold opening is performed as shown in FIGS. 4 and 9, and simultaneously the taking out of a casing from the lower mold 2 is also performed. The mold opening is started after the casting apparatus 50 allows the mold closing cylinder 22 to operate. Specifically, the casting apparatus 50 allows the mold closing cylinder 22 to be shortened to raise the upper mold 1, thereby starting the mold opening of the upper mold 1 and the lower mold 2. Then, extending action of the pushing out cylinder 30 is started simultaneously with shortening action of the mold closing cylinder 22. The pushing out cylinder 30 is elongated to push out the pushing out pin 26 (refer to FIG. 3) built in the lower mold 2. Accordingly, a casting (not shown) formed by coagulation of the molten metal in the upper mold 1 and the lower mold 2 is taken out from the lower mold 2 to be held in the upper mold 1. Then, the casting apparatus 50 raises the upper mold 1 to a prescribed position to complete the mold opening. The prescribed position is a position where a leading end of the push rod 29 and an upper face of the pushing out plate 28 of the upper mold 1 are not brought into contact with each other. In other words, the prescribed position is a position where there is a clearance between the leading end of the push rod 29 and the upper face of the pushing out plate 28 of the upper mold 1.

Next, as shown in FIGS. 4 and 10, the casting apparatus 50 drives the rotation actuator 16 to allow the tilt rotating shaft 10 of the first main link member 7*a* to perform the left-hand turn (S21). Accordingly, the casting apparatus 50 allows the upper mold 1 and the lower mold 2 to slide along an arc by operation of the parallel link mechanism to separate from each other in the horizontal direction. In the meantime, the upper mold 1 moves to a conveyor side, that is, the lower mold 2 moves in a direction approaching the pouring apparatus to become the first separation state. An angle of the left-hand turn of the rotation actuator 16 at the time is approximately 30° to 45° at which a space below the upper mold 1 is left.

Next, as shown in FIGS. 4 and 11, the casting apparatus 50 allows the mold closing cylinder 22 to be shortened to raise the upper mold 1 to the ascending end. Accordingly, the leading end of the push rod 29 pushes out the pushing out pin 26 (refer to FIG. 3) relatively with respect to the upper mold 1 through the pushing out plate 28 built in the upper mold 1. As a result, a casting held in the upper mold 1 is taken out from the upper mold 1 (S22). The casting taken out from the upper mold 1 drops to be received on a conveyor provided below the upper mold 1. That is, the conveyor also serves as a receiving unit for receiving a casting. After that, the casting is conveyed to, for example, the product cooler, the shakeout apparatus, the product finishing apparatus that removes burrs, and the like, by the conveyor. As above, the series of casting steps is completed, so that the casting apparatus 50 forms the casting. In addition, when the casting steps above are repeated, it is possible to continuously form castings.

Figure 12:
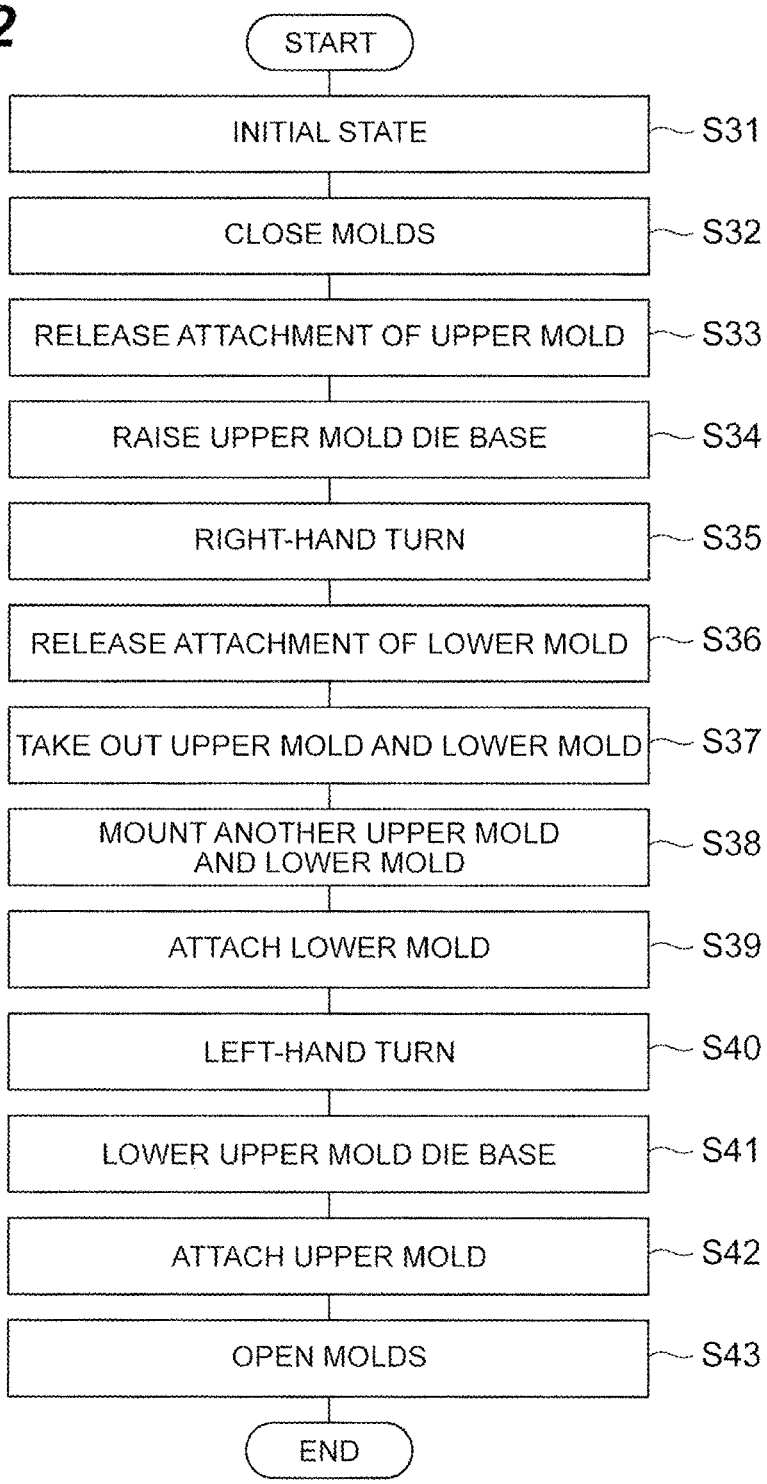
FIG. 12 is a flow chart showing a method of replacing molds of the casting apparatus of FIG. 1.

Subsequently, with reference to FIGS. 5, 7, and 12, a method of replacing molds of the casting apparatus 50 will be described. FIG. 12 is a flow chart showing a method of replacing molds of the casting apparatus of FIG. 1. As shown in FIGS. 5 and 12, first the casting apparatus 50 is set in an initial state (S31). Then, as shown in FIGS. 7 and 12, the mold closing cylinder 22 of the opening/closing mechanism 21 is elongated to lower the upper mold 1 to close the upper mold 1 and the lower mold 2 (S32). Subsequently, in a state where the upper mold 1 and the lower mold 2 are closed in this way, attachment of the upper mold 1 by the upper frame 5 is released (S33). Accordingly, the upper mold 1 is released from the upper frame 5 to become a state of being only mounted on the lower mold 2. Then, in a state where the upper mold 1 is mounted on the lower mold 2, the mold closing cylinder 22 of the opening/closing mechanism 21 is shortened to raise the upper mold die base 3 (S34).

Next, the rotation actuator 16 allows the tilt rotating shaft 10 of the first main link member 7*a* to perform the right-hand turn at a prescribed angle (here, approximately 45°) to operate the first parallel link mechanism and the second parallel link mechanism to allow the upper frame 5 and the lower frame 6 to separate from each other in the horizontal direction (S35). Accordingly, a space above the upper mold 1 and the lower mold 2 that are matched with each other to be integrated on the lower mold die base 4 is left, and the lower frame 6 moves to a work space side of an operator. In this state, attachment of the lower mold 2 by the lower frame 6 is released (S36). Accordingly, the lower mold 2 is released from the lower frame 6 to become a state of being only mounted on the lower frame 6. Subsequently, the upper mold 1 and the lower mold 2 integrated are taken out from the lower frame 6 (S37).

Next, another integrated upper mold 1 and lower mold 2 is mounted on the lower mold die base 4 (S38). After this, when reverse operation is performed, it is possible to safely and easily replace the molds. That is, first the lower mold 2 is attached to the lower frame 6 (S39). Next, the rotation actuator 16 is allowed to perform the left-hand turn at a prescribed angle (here, approximately 45°) (S40). Then, the mold closing cylinder 22 of the opening/closing mechanism 21 is elongated to lower the upper mold die base 3 (S41). Subsequently, the upper mold 1 is attached to the upper frame 5 (S42). Then, as shown in FIGS. 5 and 12, the mold closing cylinder 22 of the opening/closing mechanism 21 is shortened to raise the upper mold die base 3 to open the upper mold 1 and the lower mold 2 (S43). As a result, the casting apparatus 50 returns to the initial state, so that replacement of the molds of the casting apparatus 50 is finished. In addition, the attachment of the lower mold 2 by the lower frame 6 may be released simultaneously with release of the attachment of the upper mold 1 by the upper frame 5.

As described above, in the casting apparatus 50, the upper frame 5 to which the upper mold 1 is attached, the lower frame 6 to which the lower mold 2 is attached, and the left-and-right pair of main link members 7 and auxiliary link members 8, are coupled to each other to form the parallel link mechanism. In addition, the tilt rotating shaft 10 is provided at a central portion of the main link member 7, as well as the auxiliary link central portion rotating shaft 15 is provided at a central portion of the auxiliary link member 8. Further, the tilt rotating shaft 10 is held in the base frame 17 with the tilt rotation bearings 9 provided outside the left-and-right pair of parallel link mechanisms, as well as the auxiliary link central portion rotating shaft 15 is mounted above the base frame 17 and the rotation actuator 16 is attached to the tilt rotating shaft 10 on a drive side support frame 19 side.

Accordingly, all steps of casting, such as mold closing, mold removal, and pushing out a product, are performed in the upper frame 5 and the lower frame 6 coupled by the parallel link mechanisms. Force applied at the time of mold closing, mold removal, and pushing out a product, is received by only the parallel link mechanisms. As a result, as compared with an apparatus of the upper mold flip-up system, a structure for securing strength of each of members is simplified to enable each of the members to be reduced in size and weight.

In addition, while large force is transferred to a base frame supporting the apparatus at the time of mold opening and the like in an apparatus of the upper mold flip-up system, the parallel link mechanisms receive force in the casting apparatus 50, whereby it is possible to reduce force to be transferred to the base frame 17 supporting the apparatus. Accordingly, it is possible to reduce also the base frame 17 in size and weight. Further, as compared with an apparatus of the upper mold flip-up system, it is possible to reduce the number of actuators by using the parallel link mechanisms. As a result, it is possible to reduce the casting apparatus 50 in size and weight.

The casting apparatus 50 includes a positioning section that positions the upper mold 1 and the lower mold 2 in the horizontal direction. Accordingly, it is possible to prevent the upper mold and the lower mold from being closed so as to be displaced from each other. The positioning section is composed of the positioning key 35 provided in a lower portion of the upper mold 1 and the key groove 36 provided in an upper portion of the lower mold 2. As a result, it is possible to easily position the upper mold 1 and the lower mold 2.

In addition, in the casting apparatus 50, the upper mold 1 and the lower mold 2 are tilted by turning the tilt rotating shaft 10 of one of the pair of main link members 7 at 45° to 130° with the rotation actuator 16 in a state where the upper mold 1 and the lower mold 2 are closed by the opening/closing mechanism 21. As a result, it is possible to pour molten metal in the ladle 25 into the upper mold 1 and the lower mold 2.

Since the upper mold 1 and the lower mold 2 are allowed to separate from each other in the horizontal direction in a state of being opened, by operation of the parallel link mechanisms in the casting apparatus 50, it is possible to allow a space below the upper mold 1 and a space above the lower mold 2 to be left. As a result, when the space below the upper mold 1 is left in a case where mold removal of a casting formed is performed from the lower mold 2 to allow the casting to remain in the upper mold 1, it is possible to drop the casting to a taking out apparatus by mold removal from the upper mold 1. In addition, when a space above the lower mold 2 is left when a core is fitted, it is possible to fit the core in safety.

In the casting apparatus 50, since the rotation center of the tilt rotating shaft 10 is aligned with the center of gravity of the parallel link mechanisms, it is possible to reduce rotation energy required to turn the tilt rotating shaft 10 at the time of tilting the upper mold 1 and the lower mold 2.

The casting apparatus 50 includes the pushing out mechanism 37 so as to be capable of mold removal of a casting from the upper mold 1 by rising operation of the upper mold 1. Accordingly, an actuator for pushing out a casting from the upper mold 1 is unnecessary. As a result, the number of actuators can be further reduced, so that it is possible to further reduce the casting apparatus 50 in size and weight.

In addition, in the casting apparatus 50, it is possible to allow the upper frame 5 and the lower frame 6 to separate from each other in the horizontal direction in a state where the upper mold 1 released from attachment by the upper frame 5 is mounted on the lower mold 2 attached to the lower frame 6. Accordingly, since a space above the upper mold 1 and the lower mold 2 integrated is left as well as the lower frame 6 approaches the work space, it is possible to safely and easily replace the molds.

Further, in the casting apparatus 50, it is possible to safely and easily replace the molds as compared with an apparatus of an upper mold flip-up system. Furthermore, since the upper mold 1 and the lower mold 2 slide by operation of the parallel link mechanisms, it is possible to fit a core in safety in a state where a space above the lower mold 2 is left.

(Second Embodiment)

Figure 13:
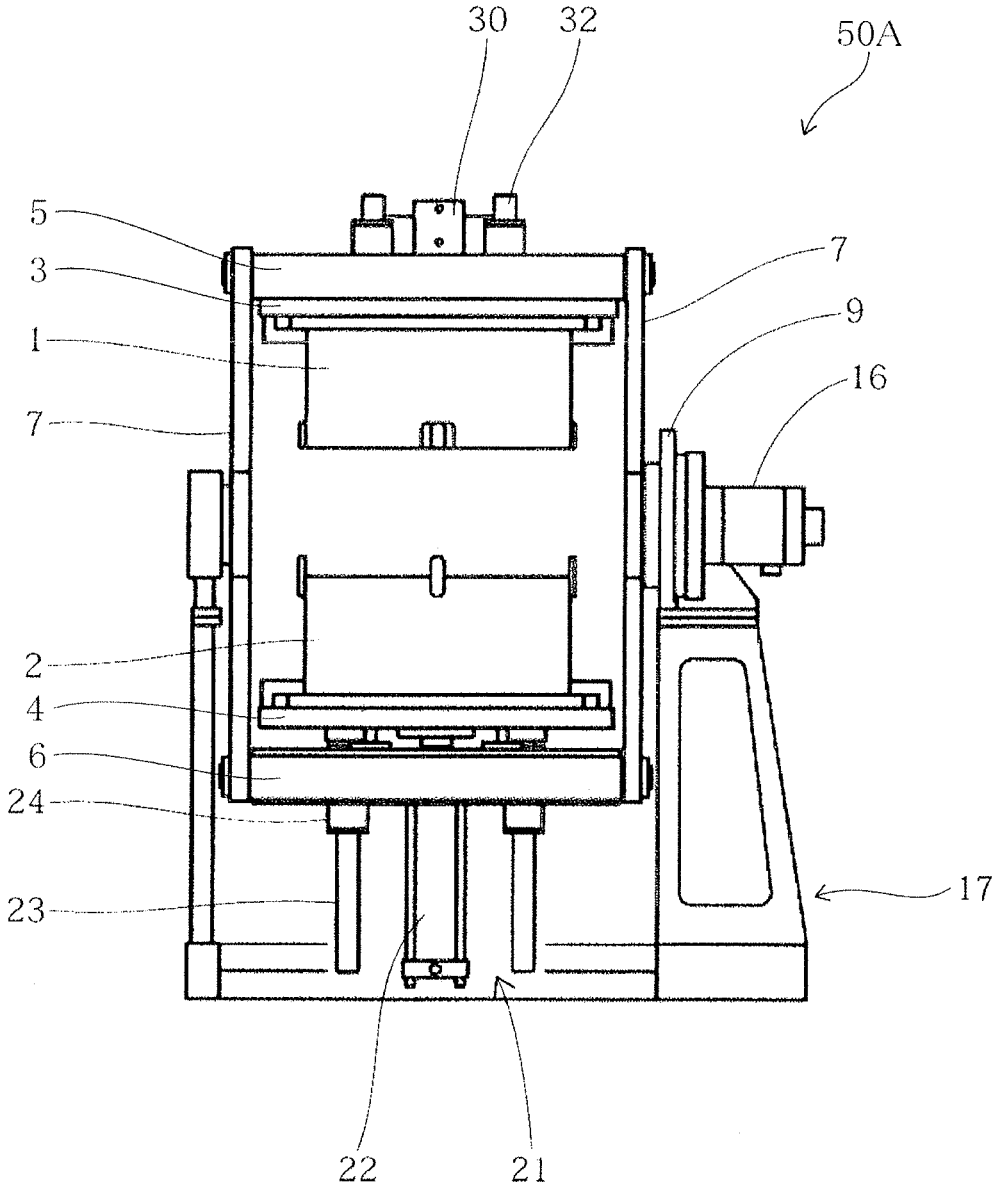
FIG. 13 is a front view of a casting apparatus in accordance with a second embodiment.

FIG. 13 is a front view of a casting apparatus in accordance with a second embodiment. As shown in FIG. 13, a casting apparatus 50A in accordance with the second embodiment is mainly different from the casting apparatus 50 in accordance with the first embodiment in that the opening/closing mechanism 21 that moves up and down the lower mold 2 is provided in the lower frame 6. Accordingly, in the casting apparatus 50A, the lower mold 2 is able to be moved up and down. Hereinafter, a difference between the casting apparatus 50A in accordance with the second embodiment and the casting apparatus 50 in accordance with the first embodiment will be mainly described without duplicated description.

Figure 14:
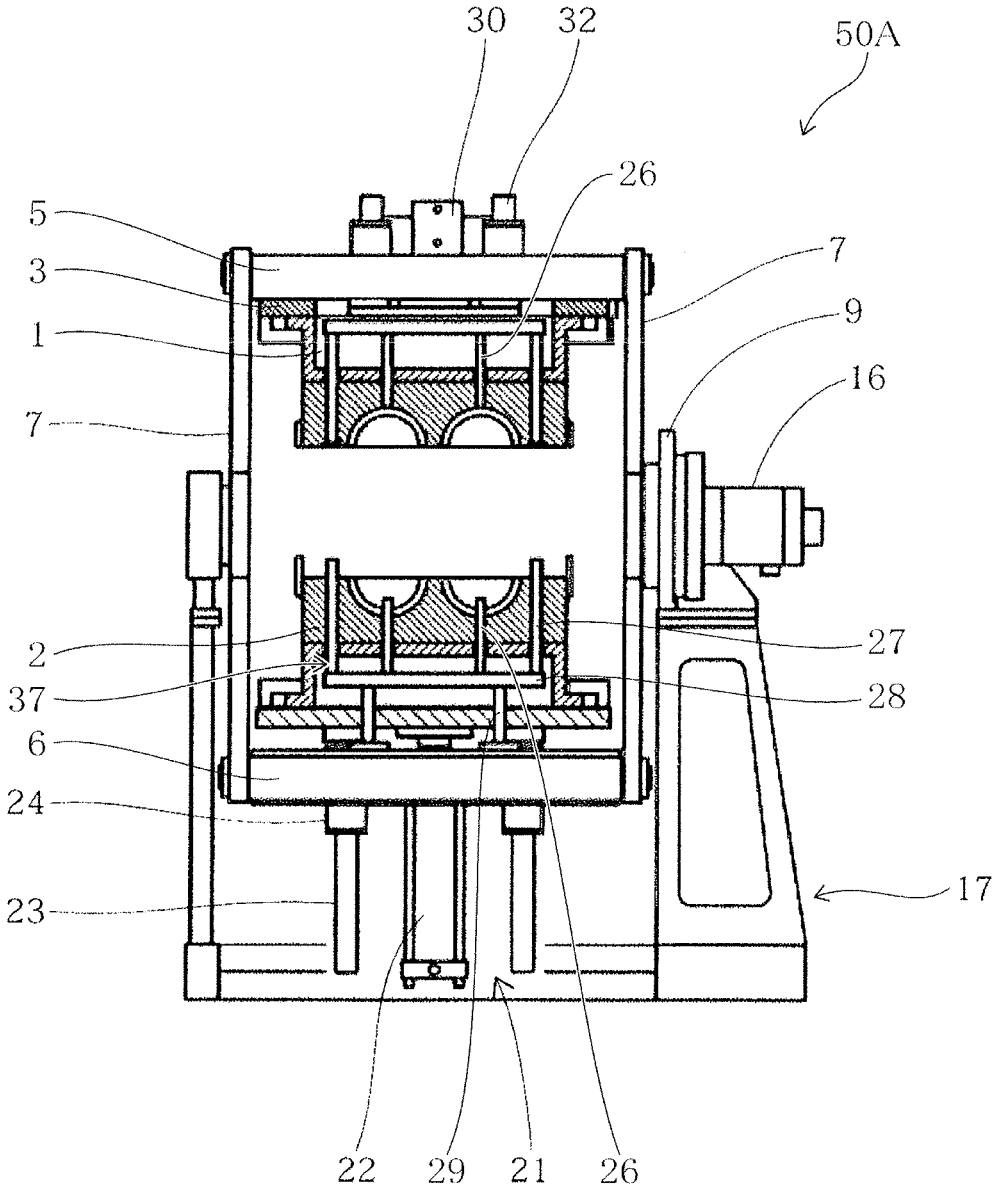
FIG. 14 shows a section of an upper mold and lower mold of FIG. 13.

FIG. 14 shows a section of an upper mold and lower mold of FIG. 13. As shown in FIG. 14, in the casting apparatus 50A, the pushing out cylinder 30 is provided in the upper frame 5, and the pushing out mechanism 37 is provided in the lower frame 6. In addition, in the casting apparatus 50A, the pushing out plate 28 is arranged in an internal space formed inside a lower end portion of the lower mold 2. Each of the pushing out pins 26 is provided in an upper face of the pushing out plate 28. Each of the pushing out pin 26 moves up and down through a hole penetrating from the internal space of the lower mold 2 to a cavity for forming a casting. Then each of the pushing out pins 26 pushes out a casting in the cavity with its leading end. Each of the return pins 27 is provided at a position different from that of each of the pushing out pins 26 in the upper face of the pushing out plate 28. Each of the return pins 27 moves up and down through a hole penetrating from the internal space of the lower mold 2 to an upper face of the lower mold 2. Then, a leading end of each of the return pins 27 is brought into contact with the lower face of the upper mold 1 to lower the pushing out plate 28 during a process in which the upper mold 1 and lower mold 2 are closed.

Each of the push rods 29 is provided in the upper face of the lower frame 6. In addition, each of the push rods 29 is arranged in the upper face of the lower frame 6 while penetrating the lower mold die base 4. In a state where each of the push rods 29 is inserted into a hole penetrating from a lower face of the lower mold 2 to the internal space, a leading end of each of the push rods 29 is arranged below the pushing out plate 28 in the internal space. Length of each of the push rods 29 is set so that each of the push rods 29 pushes up the pushing out plate 28 when the mold closing cylinder 22 is shortened to allow the lower mold 2 to reach a descending end. That is, each of the push rods 29 enters the internal space by a prescribed length through the hole penetrating from the lower face of the lower mold 2 to the internal space formed in a lower portion of the lower mold 2 to prevent the pushing out plate 28 from lowering. Other structure is the same as that of the casting apparatus 50 in accordance with the first embodiment.

In a casting method by using the casting apparatus 50A, mold removal from the upper mold 1 and mold opening are performed in parallel at step S20 described above. Specifically, the casting apparatus 50A lowers the lower mold 2 by using the opening/closing mechanism 21 provided in the lower frame 6 to start mold opening of the upper mold 1 and the lower mold 2. At the same time, extending action of the pushing out cylinder 30 provided in the upper frame 5 is started. The pushing out cylinder 30 is elongated to push out the pushing out pin 26 built in the upper mold 1. Accordingly, a casting (not shown) formed by coagulation of the molten metal in the upper mold 1 and the lower mold 2 is taken out from the upper mold 1 to be held in the lower mold 2. At step S22 described above, mold removal from the lower mold 2 is performed. Specifically, the lower mold 2 is lowered to the descending end by using the opening/closing mechanism 21. Accordingly, the leading end of the push rod 29 pushes out the pushing out pin 26 relatively with respect to the lower mold 2 through the pushing out plate 28 built in the lower mold 2. As a result, a casting held in the lower mold 2 is taken out from the lower mold 2.

In a method of replacing molds by using the casting apparatus 50A, first the lower mold 2 is raised from a state shown in FIG. 13 to close the lower mold 2 and the upper mold 1. Then, attachment of the upper mold 1 by the upper frame 5 is released. Next, the lower mold die base 4 is lowered in a state where the upper mold 1 is mounted on the lower mold 2. Subsequently, the upper frame 5 and the lower frame 6 are allowed to separate from each other in the horizontal direction by operation of the parallel link mechanisms. Then, attachment of the lower mold 2 by the lower frame 6 is released. Subsequently, the upper mold 1 and the lower mold 2 integrated are taken out from the lower frame 6, and then another integrated upper mold 1 and lower mold 2 is mounted on the lower frame 6. After this, under a procedure of performing reverse operation, it is possible to replace the molds. In addition, the attachment of the lower mold 2 by the lower frame 6 may be released simultaneously with release of the attachment of the upper mold 1 by the upper frame 5.

The casting apparatus 50A achieves the same effect as that of the casting apparatus 50 described above.

(Third Embodiment)

Figure 15:
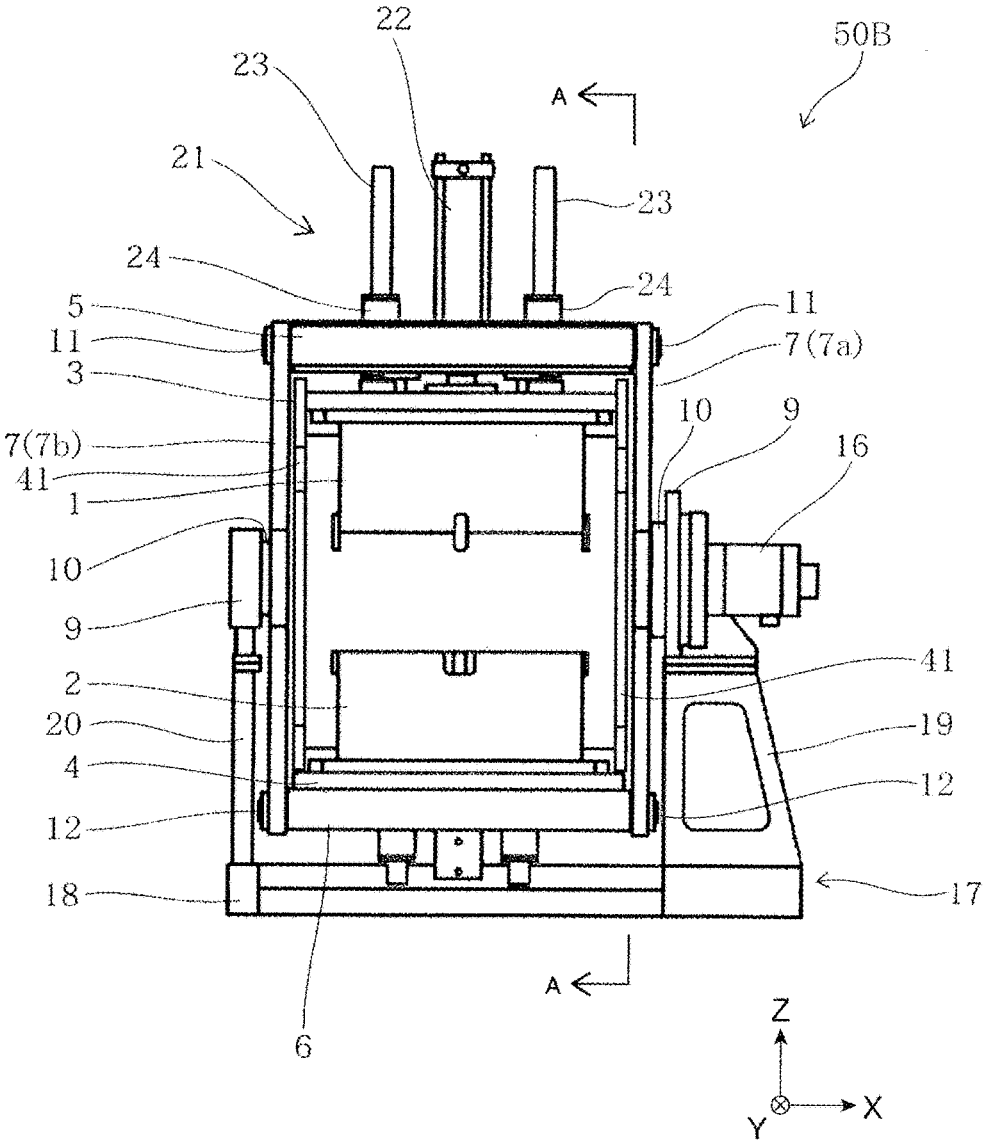
FIG. 15 is a front view of a casting apparatus in accordance with a third embodiment.
Figure 16:
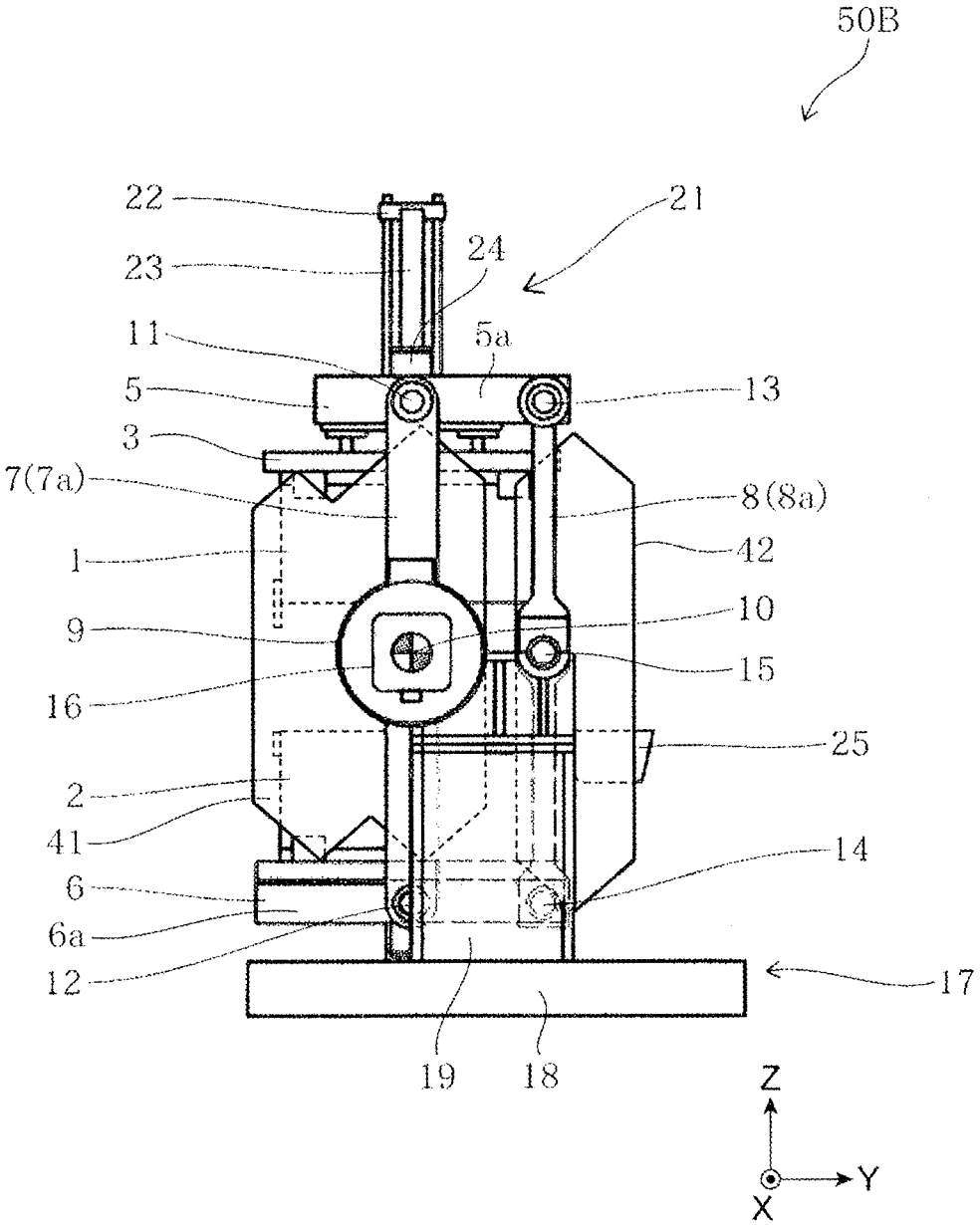
FIG. 16 is a side view of the casting apparatus of FIG. 15.

FIG. 15 is a front view of a casting apparatus in accordance with a third embodiment. FIG. 16 is a side view of the casting apparatus of FIG. 15. As shown in FIGS. 15 and 16, a casting apparatus 50B in accordance with the third embodiment is different from the casting apparatus 50 in accordance with the first embodiment in that a pair of first thermal insulation covers 41, and a pair of second thermal insulation covers 42, are provided.

The pair of first thermal insulation covers 41 is arranged in a space between the pair of main link members 7, and the upper mold 1 and the lower mold 2. Specifically, one of the first thermal insulation covers 41 is arranged in a space between the first main link member 7*a*, and the upper mold 1 and the lower mold 2. The other of the first thermal insulation covers 41 is arranged in a space between the second main link member 7*b*, and the upper mold 1 and the lower mold 2. The pair of first thermal insulation covers 41 is arranged so as to face each other in the lateral direction. (the horizontal direction, here the X direction) across the upper mold 1 and the lower mold 2. Here, the pair of first thermal insulation covers 41 is arranged parallel to each other. The first thermal insulation cover 41 is attached to the main link member 7 with a bolt or the like, for example. Then, the first thermal insulation cover 41 is attached by separating from the main link member 7.

In a space between the upper frame 5 and the lower frame 6, an area in side faces of the upper mold 1 and the lower mold 2, facing the main link member 7, is covered with the first thermal insulation cover 41. The first thermal insulation cover 41 may be formed of a heat resistance member. The first thermal insulation cover 41 is formed of a steel plate with a thickness of a few millimeters, for example. Each of the first thermal insulation covers 41 has the same shape. The first thermal insulation cover 41 is formed in a substantially rectangular shape, for example. Here, the first thermal insulation cover 41 is formed in a shape with a cut-out provided at a portion interfering with piping and wiring (not shown) of the casting apparatus 50B.

The pair of second thermal insulation covers 42 is arranged in a space between the pair of auxiliary link members 8, and the upper mold 1 and the lower mold 2. Specifically, one of the second thermal insulation covers 42 is arranged in a space between the first auxiliary link member 8*a*, and the upper mold 1 and the lower mold 2. The other of the second thermal insulation covers 42 is arranged in a space between the second auxiliary link member 8*b*, and the upper mold 1 and the lower mold 2. The pair of second thermal insulation covers 42 is arranged so as to face each other in the lateral direction (the horizontal direction, here the X direction) across the upper mold 1 and the lower mold 2. Here, the pair of second thermal insulation covers 42 is arranged parallel to each other. The second thermal insulation cover 42 is attached to the auxiliary link member 8 with a bolt or the like, for example. Then, the second thermal insulation cover 42 is attached by separating from the auxiliary link member 8.

In a space between the upper frame 5 and the lower frame 6, an area in side faces of the upper mold 1 and the lower mold 2, facing the auxiliary link member 8, is covered with the second thermal insulation cover 42. The second thermal insulation cover 42 may be formed of a heat resistance member. The second thermal insulation cover 42 is formed of a steel plate with a thickness of a few millimeters, for example. Each of the second thermal insulation covers 42 has the same shape. The second thermal insulation cover 42 is formed in a substantially rectangular shape, for example. Here, the second thermal insulation cover 42 is formed in a shape with a cut-out provided at a portion interfering with piping and wiring (not shown) of the casting apparatus 50B. Other structure is the same as that of the casting apparatus 50 in accordance with the first embodiment.

Once molten metal is poured into the upper mold 1 and the lower mold 2, the molds are heated to a high temperature. Since the main link member 7 and the auxiliary link member 8 are arranged near the upper mold 1 and the lower mold 2, the link members are subject to influence of heat of the upper mold 1 and the lower mold 2. When affected by heat, each of the main link member 7 and the auxiliary link member 8 has a thermal expansion. If there is a difference between the amount of thermal expansion of the first main link member 7*a* and the amount of thermal expansion of the second main link member 7*b* and if there is a difference between the amount of thermal expansion of the first auxiliary link member 8*a* and the amount of thermal expansion of the second auxiliary link member 8*b*, the upper mold 1 and the lower mold 2 may be inclined. Accordingly, mold removal accuracy of a casting from the upper mold 1 and the lower mold 2 may be deteriorated. Since the casting apparatus SOB achieves the same effect as that of the casting apparatus 50 described above as well as includes the first thermal insulation cover 41 and the second thermal insulation cover 42, it is possible to reduce influence of heat of the upper mold 1 and the lower mold 2 on the main link member 7 and the auxiliary link member 8. Temperature of the main link member 7 and the auxiliary link member 8 decreases by approximately 50° C. by using the first thermal insulation cover 41 and the second thermal insulation cover 42. As a result, since the amount of thermal expansion of the main link member 7 and the auxiliary link member 8 is reduced, deterioration of the mold removal accuracy of a casting from the upper mold 1 and the lower mold 2 is reduced.

Up to this point, although each of the embodiments has been described, the present invention is not limited to each of the embodiments described above. For example, instead of performing mold removal of a casting from the upper mold 1, or the lower mold 2 by using the pushing out cylinder 30, the pushing out plate 28 may be pushed out by a spring. In that case, at the time of closing the upper mold 1 and the lower mold 2, since the upper mold 1 pushes down the return pin 27 of the lower mold 2 to lower the pushing out pin 26, mold closing force is cancelled out to an extent of pushing down force of the return pin 27, however, it is possible to reduce the number of actuators.

In addition, although the mold closing cylinder 22 and the pushing out cylinder 30 may be any one of electrically-operated, hydraulically-operated, and pneumatically-operated, from the viewpoint of handling molten metal, each of the cylinders may be electrically-operated, pneumatically-operated, or hydraulically-operated without using flammable hydraulic oil. Arrangement of each of the casting apparatuses 50, 50A, and 50B is not restricted if it is possible to supply molten metal by using a pouring apparatus 60 or 60A. Thus, for example, each of the casting apparatuses 50, 50A, and 50B may be arranged in a circle so as to surround the pouring apparatus 60 or 60A. The number of each of the casting apparatuses 50, 50A, and 50B, a holding furnace 52, a core molding apparatus 54, and the pouring apparatuses 60 and 60A, may be one or more. In addition, a core may not be fitted by an operator, but be fitted by a robot with an articulated arm for fitting a core, for example. The opening/closing mechanism 21 may move up and down both of the upper mold 1 and the lower mold 2.

The casting apparatus 50B may include at least one or more of the pair of first thermal insulation covers 41 and the pair of second thermal insulation covers 42. In addition, at least one or more of side faces of the upper mold 1 and the lower mold 2 may be covered with the pair of first thermal insulation covers 41 and the pair of second thermal insulation covers 42. Further, the first thermal insulation cover 41 and the second thermal insulation cover 42 may be integrally formed with each other.

What is claimed is:

1. A casting apparatus that forms a casting by using an upper mold and a lower mold, being able to be opened, closed, and tilted, into which molten metal is poured by means of gravity, the casting apparatus comprising:

an upper frame to which the upper mold is attached;

a lower frame to which the lower mold is attached;

an opening/closing mechanism that moves up and down any one of the upper mold and the lower mold to perform mold opening or mold closing of the upper mold and the lower mold;

a first main link member whose upper end is rotatably coupled to the upper frame as well as whose lower end is rotatably coupled to the lower frame, and whose central portion is provided with a rotating shaft;

a first auxiliary link member that is arranged parallel to the first main link member, and whose upper end is rotatably coupled to the upper frame as well as whose lower end is rotatably coupled to the lower frame, and also whose central portion is provided with a rotating shaft; and a drive unit that is coupled to the rotating shaft of the first main link member to rotate the first main link member around the rotating shaft, wherein the upper frame, the lower frame, the first main link member, and the first auxiliary link member constitute a first parallel link mechanism.

2. The casting apparatus according to claim 1, further comprising:

a second main link member whose upper end is rotatably coupled to the upper frame as well as whose lower end is rotatably coupled to the lower frame, and whose central portion is provided with a rotating shaft; and a second auxiliary link member that is arranged parallel to the second main link member, and whose upper end is rotatably coupled to the upper frame as well as whose lower end is rotatably coupled to the lower frame, and also whose central portion is provided with a rotating shaft, wherein the upper frame, the lower frame, the second main link member, and the second auxiliary link member constitute a second parallel link mechanism, and wherein the first parallel link mechanism and the second parallel link mechanism are arranged parallel to each other so as to face each other across the upper mold and the lower mold.

3. The casting apparatus according to claim 2, further comprising a positioning section that positions the upper mold and the lower mold in a horizontal direction.

4. The casting apparatus according to claim 3, wherein the positioning section comprises a key provided at a lower end of a side face of the upper mold, and a groove provided at an upper end of a side face of the lower mold, the groove being able to fit with the key.

5. The casting apparatus according to claim 4, wherein the upper mold and the lower mold are tilted by turning the rotating shaft of the first main link member at 45° to 130° with the drive unit in a state where the upper mold and the lower mold are closed by the opening/closing mechanism.

6. The casting apparatus according to claim 3, wherein the upper mold and the lower mold are tilted by turning the rotating shaft of the first main link member at 45° to 130° with the drive unit in a state where the upper mold and the lower mold are closed by the opening/closing mechanism.

7. The casting apparatus according to claim 2, wherein the upper mold and the lower mold are tilted by turning the rotating shaft of the first main link member at 45° to 130° with the drive unit in a state where the upper mold and the lower mold are closed by the opening/closing mechanism.

8. The casting apparatus according to claim 2, wherein, in a state where the upper mold and the lower mold are opened by the opening/closing mechanism, the upper mold and the lower mold are allowed to separate from each other in a horizontal direction by turning the rotating shaft of the first main link member at a prescribed angle with the drive unit.

9. The casting apparatus according to claim 1, further comprising a positioning section that positions the upper mold and the lower mold in a horizontal direction.

10. The casting apparatus according to claim 9, wherein the positioning section comprises a key provided at a lower end of a side face of the upper mold, and a groove provided at an upper end of a side face of the lower mold, the groove being able to fit with the key.

11. The casting apparatus according to claim 10, wherein the upper mold and the lower mold are tilted by turning the rotating shaft of the first main link member at 45° to 130° with the drive unit in a state where the upper mold and the lower mold are closed by the opening/closing mechanism.

12. The casting apparatus according to claim 9, wherein the upper mold and the lower mold are tilted by turning the rotating shaft of the first main link member at 45° to 130° with the drive unit in a state where the upper mold and the lower mold are closed by the opening/closing mechanism.

13. The casting apparatus according to claim 9, wherein, in a state where the upper mold and the lower mold are opened by the opening/closing mechanism, the upper mold and the lower mold are allowed to separate from each other in a horizontal direction by turning the rotating shaft of the first main link member at a prescribed angle with the drive unit.

14. The casting apparatus according to claim 1, wherein the upper mold and the lower mold are tilted by turning the rotating shaft of the first main link member at 45° to 130° with the drive unit in a state where the upper mold and the lower mold are closed by the opening/closing mechanism.

15. The casting apparatus according to claim 1, wherein, in a state where the upper mold and the lower mold are opened by the opening/closing mechanism, the upper mold and the lower mold are allowed to separate from each other in a horizontal direction by turning the rotating shaft of the first main link member at a prescribed angle with the drive unit.

16. The casting apparatus according to claim 1, wherein a rotation center of the rotating shaft of the first main link member is aligned with the center of gravity of a rotating unit including the upper mold and the lower mold, opened or closed, and the upper frame and lower frame.

17. The casting apparatus according to claim 1, wherein the opening/closing mechanism is provided in the upper frame and performs mold opening and mold closing of the upper mold and the lower mold by moving up and down the upper mold, the casting apparatus further comprising a pushing out mechanism, the pushing out mechanism comprising:

a pushing out plate that is arranged in a space formed inside an upper end of the upper mold, and that is able to move up and down;

a pushing out pin that is provided in a lower face of the pushing out plate to move up and down through a hole penetrating from the space of the upper mold to a cavity for forming the casting, and whose leading end pushes out the casting in the cavity;

a return pin that is provided at a position different from that of the pushing out pin in the lower face of the pushing out plate to move up and down through a hole penetrating from the space of the upper mold to a lower face of the upper mold, and whose leading end is brought into contact with an upper face of the lower mold to raise the pushing out plate during a process in which the upper mold and the lower mold are closed; and a regulation member that is provided in a lower face of the upper frame, and whose leading end is arranged above the pushing out plate in the space while inserted into a hole penetrating from an upper face of the upper mold to the space.

18. The casting apparatus according to claim 1, wherein the opening/closing mechanism is provided in the lower frame and performs mold opening and mold closing of the upper mold and the lower mold by moving up and down the lower mold, the casting apparatus further comprising a pushing out mechanism, the pushing out mechanism comprising:

a pushing out plate that is arranged in a space formed inside a lower end of the lower mold, and that is able to move up and down;

a pushing out pin that is provided in an upper face of the pushing out plate to move up and down through a hole penetrating from the space of the lower mold to a cavity for forming the casting, and whose leading end pushes out the casting in the cavity;

a return pin that is provided at a position different from that of the pushing out pin in the upper face of the pushing out plate to move up and down through a hole penetrating from the space of the lower mold to an upper face of the lower mold, and whose leading end is brought into contact with a lower face of the upper mold to lower the pushing out plate during a process in which the upper mold and the lower mold are closed; and a regulation member that is provided in an upper face of the lower frame, and whose leading end is arranged below the pushing out plate in the space while inserted into a hole penetrating from a lower face of the lower mold to the space.

19. The casting apparatus according to claim 1, further comprising a thermal insulation cover arranged in a space between at least one of the first main link member and the first auxiliary link member, and at least one of the upper mold and the lower mold.

20. A method of replacing molds of a casting apparatus that forms a casting by using an upper mold and a lower mold, being able to be opened, closed, and tilted, into which molten metal is poured by means of gravity, the casting apparatus comprising:

an upper frame to which the upper mold is attached;

a lower frame to which the lower mold is attached;

an opening/closing mechanism that moves up and down any one of the upper mold and the lower mold to perform mold opening or mold closing of the upper mold and the lower mold;

a first main link member whose upper end is rotatably coupled to the upper frame as well as whose lower end is rotatably coupled to the lower frame, and whose central portion is provided with a rotating shaft;

a first auxiliary link member that is arranged parallel to the first main link member, and whose upper end is rotatably coupled to the upper frame as well as whose lower end is rotatably coupled to the lower frame, and also whose central portion is provided with a rotating shaft; and a drive unit that is coupled to the rotating shaft of the first main link member to rotate the first main link member around the rotating shaft, wherein the upper frame, the lower frame, the first main link member, and the first auxiliary link member constitute a first parallel link mechanism, the method comprising:

a step of releasing attachment of the upper mold by the upper frame in a state where the upper mold and the lower mold are closed by the opening/closing mechanism;

a step of allowing the upper frame and the lower frame to separate from each other in the horizontal direction by turning the rotating shaft of the first main link member at a prescribed angle with the drive unit to operate the first parallel link mechanism;

a step of releasing attachment of the lower mold by the lower frame; and a step of extracting the upper mold and the lower mold from the lower frame and mounting another upper mold and lower mold on the lower frame.

* * * * *